US005386650A

United States Patent [19]

Storz

[11] Patent Number: 5,386,650

[45] Date of Patent: Feb. 7, 1995

[54] SKI BOOT WITH A DAMPING DEVICE BETWEEN THE SHELL AND SHAFT

[75] Inventor: Achim Storz, Zell/See, Austria

[73] Assignee: Kneissl Dachstein Sportartikel Aktiengellschaft, Molln, Austria

[21] Appl. No.: 116,538

[22] Filed: Sep. 2, 1993

Related U.S. Application Data

[63] Continuation of Ser. No. 474,797, Jul. 27, 1990, abandoned.

[30] Foreign Application Priority Data

Nov. 27, 1987 [AT] Austria ..... 3128/87

[51] Int. Cl.[6] ..... A43B 5/04

[52] U.S. Cl. ..... 36/118; 36/117; 36/120; 36/121

[58] Field of Search ..... 36/109, 54, 50, 117–121, 36/50.5

[56] References Cited

U.S. PATENT DOCUMENTS

| | | | |
|---|---|---|---|
| 3,820,256 | 6/1974 | Schoch | 36/120 |
| 3,975,838 | 8/1976 | Martin | 36/121 |
| 4,404,758 | 9/1983 | Kopp | 36/121 |
| 4,455,768 | 6/1984 | Salomon | 36/121 |
| 4,501,078 | 2/1985 | Kopp | 36/121 |
| 4,575,958 | 3/1986 | Arieh et al. | 36/121 |
| 4,583,306 | 4/1986 | Paris | 36/119 |
| 4,653,205 | 3/1987 | Koch | 36/121 |
| 4,665,635 | 5/1987 | Benoit et al. | 36/120 |
| 4,693,020 | 9/1987 | Salas et al. | 36/121 |
| 4,694,593 | 9/1987 | Petrini et al. | 36/121 |
| 4,761,899 | 8/1988 | Marxer | 36/50.5 |
| 4,777,742 | 10/1988 | Petrini et al. | 36/121 |
| 4,864,743 | 9/1989 | Begey et al. | 36/119 |
| 5,063,693 | 11/1991 | Morell et al. | 36/121 |

FOREIGN PATENT DOCUMENTS

| | | | |
|---|---|---|---|
| 331672 | 8/1973 | Austria . | |
| 374094 | 5/1981 | Austria . | |
| 0113908 | 12/1983 | European Pat. Off. . | |
| 0123636 | 10/1984 | European Pat. Off. | 36/120 |
| 172159 | 2/1986 | European Pat. Off. | 36/121 |
| 285924 | 10/1988 | European Pat. Off. | 36/117 |
| 2341283 | 9/1977 | France | 36/121 |
| 2511229 | 3/1982 | France . | |
| 2495901 | 6/1982 | France | 36/120 |
| 2498431 | 7/1982 | France | 36/120 |
| 2544596 | 4/1983 | France . | |
| 2556187 | 12/1983 | France . | |
| 2539278 | 7/1984 | France | 36/121 |
| 2341658 | 3/1974 | Germany . | |
| 2128769 | 12/1976 | Germany . | |
| 2635998 | 3/1977 | Germany | 36/121 |
| 3429237 | 2/1986 | Germany . | |
| 3429891 | 2/1986 | Germany . | |
| 642520 | 8/1979 | Switzerland . | |

*Primary Examiner*—Paul T. Sewell
*Assistant Examiner*—Thomas P. Hilliard
*Attorney, Agent, or Firm*—Collard & Roe

[57] ABSTRACT

An improved composite shell-type ski boot having an outer shell for enclosing a foot and a shaft pivotally supported on the outer shell for enclosing a lower part of a lower leg. The ski boot also includes an interior shoe, an instep opening in the outer shell and an articulated cover coupled to a front end of the boot extending to the shaft and being flexible in a transition region between a foot and a shinbone. The boot further includes an adjustment device to adjust a forward position of a shaft with respect to the outer shell and damping between the shaft and the outer shell. The adjustment device includes a guide element connected to the shaft and movable relative to the adjustment device for freely pivoting the shaft on the outer shell. The adjustment device also includes a coupling device for blocking movement of the guide element.

10 Claims, 24 Drawing Sheets

Fig. 22
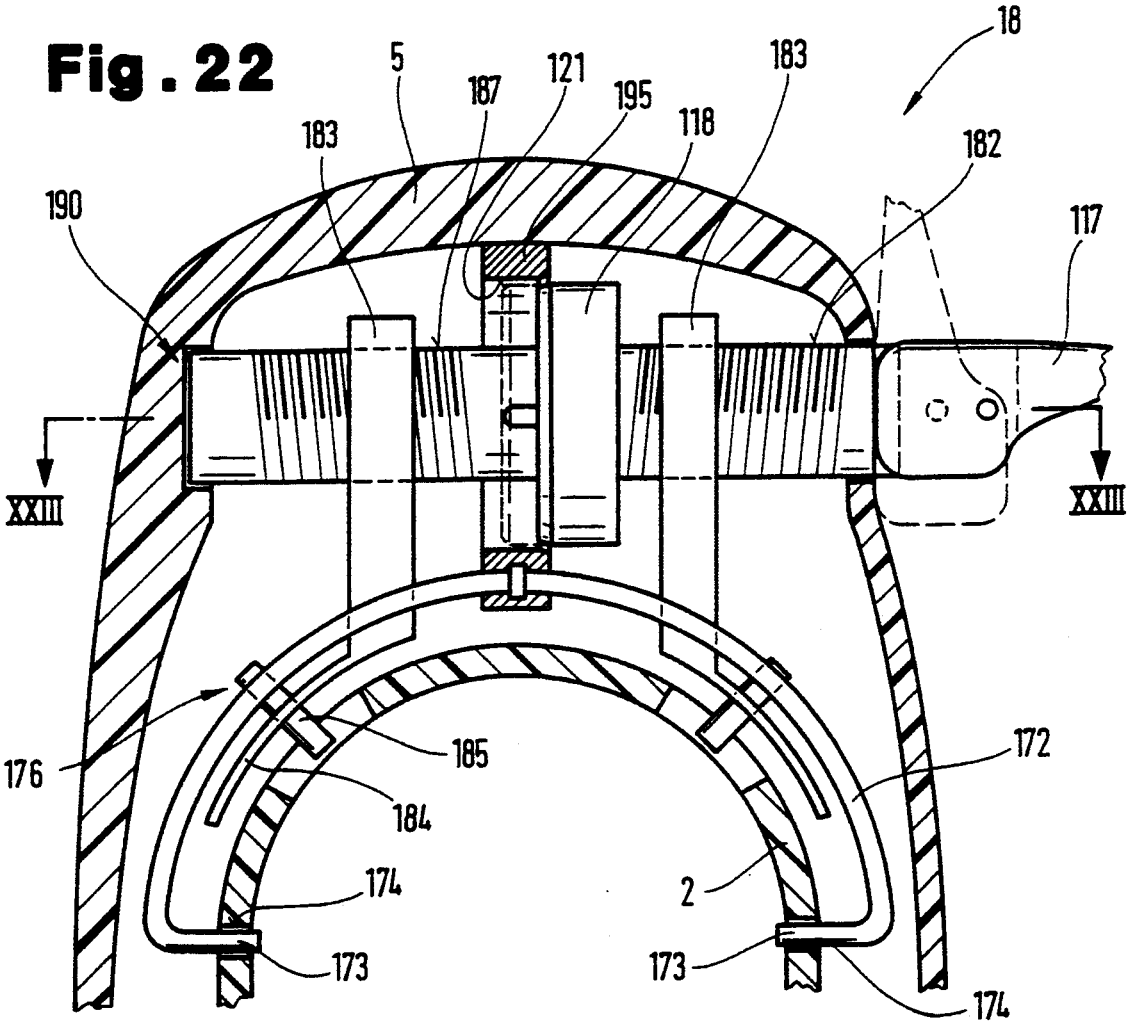
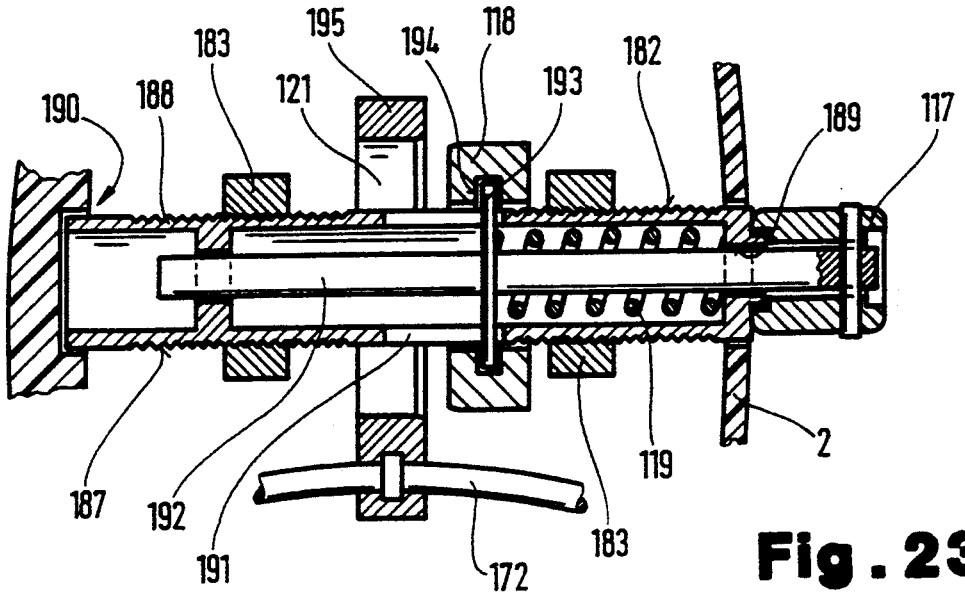
Fig. 23

SKI BOOT WITH A DAMPING DEVICE BETWEEN THE SHELL AND SHAFT

This is a continuation of copending application(s) Ser. No. 07/474,797, filed on Jul. 27, 1990, now abandoned.

BACKGROUND OF THE INVENTION

2. Field of the Invention

The invention relates to a ski boot with a shell and a composite shaft, with a lower part of the shell which has a longitudinal slit on the side opposite to the sole, extending from the tip of the shoe to the heel region, and with a shell cover arranged on the lower part of the shell, extending from the region of the tip to the shaft above the longitudinal slit, especially connected as a single piece with the lower part of the shell, of at least one front flap and one rear flap which form the shaft and are connected to the shell via swivelling axes and with closure devices and adjustment devices between the individual parts or flaps of the ski boot and with a damping device for the forward position arranged between the shaft and the lower part of the shell.

2. The Prior Art

The most varied embodiments for ski boots have already become known, some of which are intended for entering from the front, some from the rear, and some with a so-called central entry. These various forms of entry are intended to make it as easy as possible to get into and out of the ski boot, on the one hand, to allow the most advantageous possible transfer of forces between the foot and the ski, on the other hand.

A known ski boot—according to FR-A 2 498 431—has a shaft consisting of a front and a rear flap, which is mounted to pivot on the lower part of the shell via swivelling axes. Between the boot tip and the initial region of the front flap facing it, a shell cover is arranged. This is surrounded by a closure device, which is arranged on brackets of the front flap, which extend in the direction of the boot tip on both sides of the shell cover. The rear flap of the shaft has a damping device for forward position assigned to it. By arranging the closure device on the brackets of the front flap which extend in the direction of the boot tip, the effect of the forward position damping device is almost completely eliminated in the region of the rear flap of the shaft, so that satisfactory damping of the forward position movement and a tight seal between the shell cover and the front flap of the shaft cannot be achieved.

Another known ski boot—according to AT-B 374 094—consists of a lower shell part and a one-piece shaft which can be pivoted relative to it via a joint. A shell cover is arranged in the front foot and instep region, which extends into the region of the shaft. In the instep region, in other words in the transition between the front foot region of the shell and the shaft, the shell cover is provided with groove-like depressions which run perpendicular to the longitudinal direction, as an insert damping device. These result in weakening of the shell cover, with the damping characteristics being changed, depending on the shape of the grooves, with different insert positions. An exact guidance of the shell cover cannot be achieved with different forward positions with this version of the shell cover, since longitudinal deformation, in particular, cannot be prevented in the direction of the boot tip. This means that exact guidance of the foot in the ski boot cannot be achieved.

Various embodiments of such ski boots, which can be opened in a large region in order to make it easy to step into and out of them, are known from DE-OS 23 41 658, AT-PS 331 672 and DE-OS 34 29 237, among others. These known ski boots have the common characteristic that a shell cover can be pivoted relative to the sole, around an axis which runs perpendicular to the longitudinal direction of the sole, so that a region between the rear flap of a shaft and an instep region is opened up, to make it easier to slip into and out of the boot. In some versions, the shell cover can be pivoted forward so far that the entire foot bed is accessible from above. Although such a structure of the ski boots makes it easier to get into and out of them, the movement progression when the boot is closed, especially with regard to pivoting of the shaft relative to the shell, is not satisfactory, and seal problems occur in the transition region between the lower part of the shell and the shell cover that can be swivelled, particularly in those ski boots in which the upper part of the shell can be pivoted up over the entire length.

Another embodiment of ski boots is known, for example, from DE-AS 21 28 769, CH-PS 642 520 and DE-OS 34 29 891. In these known ski boots, the rear flap of the shaft is formed in such a way that it can be pivoted back around a greater angle than the front flap can be pivoted forward. This makes entry easier, due to the larger clear space in the heel region. In order to allow pivoting of the rear flap to such a great extent, a corresponding arrangement of the pivot points is required, which usually means that the movement of the shaft cannot be optimally adjusted to the movements of the lower leg during skiing, relative to the foot.

SUMMARY OF THE INVENTION

The present invention is now based on the task of creating a ski boot of the type stated initially, which makes it possible to get into and out of the boot easily, and which, in the closed state, allows good fixation of the foot in the boot, even at different angle positions between the foot and the lower leg. In addition, good adaptation of the boot to the transition region between the instep and the base of the shim is supposed to be possible. If necessary, it should also be possible to damp the forward position movements between the shell and the shaft. Furthermore, it should preferably be possible to shut out this damping device, while the shaft is closed.

This task of the invention is accomplished in that the shell cover extends into the region of an end of the front flap of the shaft, opposite to the sole, and that a support surface which rests against the shell cover and is connected to the shaft surrounds the shaft in the instep region, in the region of which support surface a closure device formed by a buckle arrangement and extending between the front and rear flap is arranged, and that an instep cover of the shell cover can be pivoted relative to a cover for the front part of the foot which forms part of the instep cover, about an axis perpendicular to a longitudinal direction of the sole and approximately parallel to the sole, which instep cover is fixed in place relative to the lower part of the shell, by a closure device which is arranged adjacent to the axis in the direction of the boot tip, and is especially comprised of a buckle arrangement.

By the interaction of the instep cover of the shell cover with the support surface connected with the shaft, an opposite and equal relative movement of the instep cover and the support surface approximately vertical to the sole is achieved, in advantageous manner, when the lower leg is moved forward, so that exact guidance of the instep is maintained during the entire forward movement. At the same time, this embodiment of the ski boot also achieves that when the shaft, i.e. the ski boot is opened, the front flap can be pivoted forward independent of the instep cover, and that therefore the movement of the instep cover in the direction of the shaft is released, because the support surface is pivoted away. This makes it possible for the instep cover to be pressed up and forward when the foot is removed from the boot, and therefore the greatest possible freedom of movement of the foot between instep and heel is achieved, when the rear flap is pivoted away at the same time. By pivoting the front and rear flaps in opposite directions, and because of the possibility of moving the instep cover in the direction of the front flap, also, a so-called "central entry" is achieved. Without any additional mechanical means, such as pulleys or similar items, an adjustment device for heel adjustment can therefore be achieved when the shaft is closed, and the instep cover can be brought into the desired position, adapted to the anatomical position of the foot, with the support surface. It is surprising in this connection that with such a solution, the pivot axis for the shaft can be arranged approximately in the ankle region, i.e. in the region of the ankle axis, which means that the pivot region of the shaft can follow the natural movements of the lower leg relative to the foot quite easily. Adjustment of the instep cover to the various operating positions, such as open front flap or closed front flap, is simplified by the axis around which the instep cover is mounted to pivot, and in particular, this part is given a targeted movement path, which promotes guidance, free of play, of the foot between the heel and the instep.

According to a further embodiment, it is possible that the lower part of the shell and the shell cover form separate components, which means that the structure of the pivot axis can be more simply adapted to the load and the desired movement progression in each case.

It is furthermore advantageous if front foot cover and the instep cover of the shell cover are formed in one piece, since this simplifies the effort involved in the manufacture of the instep cover according to the invention.

According to another embodiment, it is possible that a weakening line is arranged between the front foot cover and the instep cover, which is preferably formed of a cross-sectional weakening, which makes additional mechanical effort for manufacture of the axis unnecessary.

However, it is also possible that the cross-sectional weakening is formed by a groove-shaped depression in the front foot cover which runs lateral to the longitudinal direction of the sole, the groove base of which has a lesser length than one width of the front foot cover, since this means that when suitable materials are used, their inherent elasticity can simultaneously be used for pivoting of the parts relative to one another.

However, it is also possible that a pivot arrangement is arranged between the front foot cover and the instep cover, which has a pivot axis which forms the axis, which means that the resistance against forward pivoting of the front flap can be kept uniform approximately over the entire pivot region.

According to another embodiment, it is provided that the front foot cover and the instep cover are mounted to pivot independently of one another, on the pivot axis of the pivot arrangement, which makes it possible to arrange the mounting position of the pivot axis of the pivot arrangement directly in the individual covers.

According to another embodiment, it is provided that the pivot arrangement is arranged between the instep cover and the lower part of the shell, which makes it possible to achieve good anchoring without stress on the front foot cover.

However, it is also possible that the weakening line or the axis is fixed relative to the lower part of the shell, by means of the closure device arranged directly adjacent to it in the direction of the boot tip, especially formed of a buckle arrangement, which makes it possible to achieve a good seal between the front foot cover and the lower part of the shell, as well as fixation of the weakening line or the pivot axis in the longitudinal direction, at the same time. Because of this additional support, it is not necessary for the instep cover to transfer all the forces which act on it in the longitudinal direction of the sole, and it can therefore be designed in a less sturdy fashion.

According to another embodiment, it is provided that the pivot axis which forms the axis is mounted in the lower part of the shell, which makes good anchoring of the pivot axis possible and allows relative movement of the instep cover, relative to the lower part of the shell, to take place.

Furthermore it is possible that the closure device, e.g. the buckle arrangement is arranged in the groove-like depression and that the weakening line is formed by the transition between the groove base and a groove flank which faces towards the instep cover. By using an edge of the molded part directly adjacent to the closure device as the weakening line, the desired movement geometry can be achieved with simple means.

However, it is also possible that the shell cover is connected with the lower part of the shell in the region of the boot tip by means of a holder device, which makes assembly of the shell cover easier.

An embodiment, according to which the holder device is rigidly attached to the lower part of the shell in the longitudinal direction of the sole is also advantageous, since such an embodiment makes it possible to support the instep cover over the shell over in the longitudinal direction of the sole.

According to another embodiment, it is provided that the shell cover can be pivoted around an axis which runs approximately parallel to the axis, in the region of the holder device, which simplifies removal of the interior shoe and also makes it easier to get into and out of the ski boot.

However, it is also advantageous if the instep cover is preferably guided in a sliding track, which is arranged in the lower part of the shell, between the axis and the heel region, since the additional guidance of the instep cover in the sliding track reduces the stress on the weakening line and the desired movement progression of the instep cover can be maintained even under severe stress.

Furthermore, it is also possible that the sliding track is formed by longitudinal slits arranged in the region of two side walls of the lower part of the shell, which slits are angled at a slight angle between 5° and 30°, preferably 15°, in the direction of the boot tip, relative to a perpendicular angle to the sole. This allows the end of the instep cover facing away from the weakening line or axis to be moved into a direction corresponding to the desired movement progression under stress by the instep or the shin continuation, and particularly not to move laterally or in an undesirable direction under stress.

Furthermore, it is also possible that the sliding track is in the shape of a circular arc and that its center is formed by the axis, which makes it possible to prevent distortion in the instep cover and thereby excess stress on the axis.

According to another embodiment it is provided that the sliding track is in the shape of a circular arc and that its center is located in the region of the holder device of the shell cover, which means that there is no additional stress on the shell cover when getting into or out of the ski boot.

However, an embodiment variation according to which the sliding track has two circular arc sections with different radii is also advantageous, since this allows movement of the instep cover when the ski boot is closed, moved relative to the weakening line or axis, while after the shaft, i.e. the ski boot is opened, further movement of the instep plate can take place with reference to the other joint points, for example the shell cover.

According to another variation, it is also possible that one width of the sliding track is greater than one diameter or one width of the guide elements guided in this track, since this allows equalization of the movement with different pivot radii of the instep plate, by the difference in the dimensions between the guide elements and the sliding tracks.

According to another embodiment of the invention it is provided that the front and rear flaps are mounted on the pivot axes arranged in both side walls of the lower part of the shell, preferably in common for both, which makes it possible to achieve a movement of the shaft section correspondingly adapted to the movement of the lower leg relative to the foot, in advantageous manner.

For this, it is advantageous if the front flap has an approximately semi-cylindrical shape and has a U-shaped cutout in the center between the side edges, extending from the bottom frontal edge in the direction of an upper frontal edge, since this allows a correspondingly great mobility of the front flap relative to the shell or the shell cover.

According to another preferred embodiment it is provided that a slit extending in the direction of the upper frontal edge, especially one that narrows, is arranged on the U-shaped cutout, ending at a distance below the upper frontal edge. This solution allows greater freedom of movement for closing the shaft, so that the latter can be better adapted to the varying anatomical progression of the foot in the lower leg region immediately following the foot.

It is furthermore advantageous if a base of the U-shaped cutout forms the support surface, since when the ski boot is closed, the shaft section, in other words the front flap, can be used simultaneously to support and guide the instep plate.

Furthermore, it is also possible, however, that the front flap holds a support plate, the frontal edge of which, facing the frontal end, forms the support surface, which means that the front flap does not have to be as massive and additional protection for the shin results from the use of a support plate.

However, it is also possible that the front flap consists of two front flap pieces, each of which is mounted on one of the pivot axes arranged in the opposite side walls, since this makes adaptation to various lower leg diameters even easier.

It is advantageous for this if the front flap parts are connected with one another via the support plate, since this makes it possible to achieve the necessary strength of the front flap, by using the support plate.

However, an embodiment is also possible in which the support plate can be adjusted relative to the front flap or the front flap parts, in the circumference direction of the front flap or the front flap parts, at least along a part of the guide arrangements which extend from both sides of the cutout and/or the slit, which allows infinite adjustment of the shaft width to various lower leg dimensions in a certain region.

Furthermore, it is also possible, however, that between the front flap or the front flap parts and the rear flap, closure devices formed of buckle arrangements are provided, and that a buckle arrangement holds the support surface, with the support surface preferably being arranged on a support plate connected with the buckle arrangement, since this makes it possible to adapt the position of the support plate exactly to the setting of the shaft, which has been fixed with the buckle arrangement.

It is furthermore advantageous if the buckle arrangement is anchored in the rear flap and preferably passes through it, since this achieves good anchoring and guidance of the buckle arrangement in the region of the rear flap.

It is furthermore advantageous if the buckle arrangement has a catch strap, which is connected with an activation lever via an eccentric buckle and with the rear flap by means of a carrier strap, and if a stop element is assigned to the catch strap, which in turn is anchored in the rear flap via a carrier strap, since this makes possible delicate adjustment of the tension forces which act on the foot, i.e. the closure forces for adaptation of the shaft to the progression of the lower leg.

According to a further embodiment it is provided that the carrier strap for the stop element and the catch strap is made of one piece, which means that unbuckling can be achieved with an attachment location for the carrier strap, preferably in the region of the rear flap.

However, it is furthermore also possible that holder elements are assigned to the carrier strap in the region of the two side walls of the rear flap, and that the holder elements are preferably adjustable in the direction of the longitudinal axis of the sole, which achieves centered alignment of the buckle and therefore centered tension on the shaft.

According to another embodiment, it is provided that the carrier strap penetrates the side wall of the rear flap in the region of the holder elements and that the holder elements are connected with an adjustment device which can be adjusted in the longitudinal direction of the sole, which additionally allows centering of the buckle arrangement.

However, it is also possible that the holder element is provided with a stop element for the carrier strap, which creates the prerequisite that a section of the carrier strap which extends into the interior of the ski boot can be utilized for additional functions.

According to another embodiment it is provided that a support bracket for the heel is arranged on the carrier strap section which runs between the two holder elements, in the interior of the shaft, which means that the carrier strap can be used not only for the buckle arrangement but simultaneously also for heel support, and that with a suitable structure, the heel support is released when the buckle arrangement is released, in other words when the front and rear flap are opened, which achieves even greater freedom of movement for getting into or out of the ski boot.

According to a further embodiment, it is provided that the buckle arrangement comprises an eccentric buckle with catch straps arranged at both ends, and that stop elements, separate from one another, are assigned to them in the region of the rear flap, with the eccentric buckle and/or the catch straps being anchored in these catch elements, adjustable relative to the front flap, which means that the eccentric buckle can always be closed in the center.

It is advantageous in this connection if the two stop elements are arranged in the side walls of the rear flap, especially countersunk, since this prevents tangling in the region of the stop elements.

However, it is also possible that the front flap and the rear flap are connected with the side walls of the lower part of the shell via independent, separate pivot axes, which means that the opening distance of the front and rear flap can be additionally increased, corresponding to the arrangement of the two separated pivot axes.

However, if is even advantageous if the rear flap is mounted via pivot axes on the front flap which rests on the lower part of the shell via pivot axes, since in this embodiment, in the closed state, a uniform pivot axis can be achieved, for example in the region of the ankle pivot axis, while a greater opening width and therefore easier entry and exit from the boot is achieved when the ski boot is open, as compared to an arrangement of the front and rear flap on a common axis.

Another embodiment provides that the shaft is connected with an adjustment device for the forward position or forward position damping, which is arranged between the front flap and/or the rear flap and the lower part of the shell, and which has a damping device, for example formed by a spring, which allows corresponding damping of the forward position after closing of the shaft.

Furthermore, it is advantageous if the front and/or rear flap can be guided in a guide device of the adjustment device, relative to the latter, and if a coupling device that can be opened is arranged between the front and/or rear flap and the adjustment device. By eliminating the function of the damping device, as necessary, via the coupling device that can be opened, the movement of the front or rear flap is not hindered by this damping device when the ski boot is opened, and in the closed state, forward positioning of this part can take place, while in the opened state, free mobility continues to be available and therefore it is easier to get into and out of the ski boot.

According to another embodiment it is provided that the adjustment device for adjusting the forward position and/or the forward position damping of the shaft is arranged in the instep region between the lower part of the shell and the front flap, which achieves simpler operation with less stress on the buckle arrangement which connects the front flap with the rear flap.

Furthermore, it is also possible that in the overlap region of the front flap and the lower part of the shell, a spring element is arranged as a damping device, which extends from a region of one side wall most adjacent to the sole over the shell cover, into the region of the opposite side wall in the region of the sole and is held in place in a holder device in the region of its ends facing towards the sole. The advantage of this solution lies in the fact that such a spring element can be built very low and therefore an optically advantageous shape of a ski boot can be achieved, and at the same time, the advantages of such a damping device can be achieved with simple operation.

It is also advantageous if the holder device has a bore which passes through the lower part of the shell approximately parallel to the sole, into which the shanks of the spring element, which run approximately parallel to the sole, mesh, and if the holder device furthermore comprises a counter-bearing arranged on the lower part of the shell between the spring element and a boot tip, between the bore and the shell cover, and if the spring element is attached in a guide plate, which forms a guide device with guide slits in the housing of the adjustment device, with the guide slits of the housing being arranged on the side of the front flap which faces towards the lower part of the shell, and the locking tab of the coupling device penetrating the front flap and its eccentric lever being arranged on the side of the front flap facing away from the lower part of the shell, since this allows secure hold of the spring element and also the absorption of greater spring forces. Nevertheless, the size and number of passages in the region of the front flap are kept small, so that in spite of the varied adjustment and setting possibilities of the ski boot, a high level of seal of the boot is achieved.

However, it is also possible that a bore in the guide plate is assigned to the locking tab, which makes it possible to produce a simple connection between the front flap and the lower part of the shell, which also allows transfer of the adjustment movements to be damped, without play.

According to a further development, it is provided that the counter-bearing has a height that is greater than a distance between the facing surfaces of the lower part of the shell and the shell cover and that the counter-bearing, which has a round or multi-angular cross-section, is guided in a groove of the front flap which faces the lower part of the shell, with the groove being arranged on a connection line between the boot tip and the rear flap, which makes it possible to use the part needed as a counter-bearing for the spring element also to limit the maximum adjustment path of the front flap relative to the lower part of the shell. This means that unbuckling can be achieved with a low number of individual parts, which also means that the assembly costs will not be detrimentally affected when using such a setting device.

It is furthermore advantageous if the counter-bearing for the spring element is arranged on a setting element, e.g. an adjustment strip of an adjustment device, since this makes it possible to easily adapt the spring characteristics to various conditions in forward position movements, for example in deep snow or on hard trails.

A low height of the setting device is furthermore achieved if the setting element is formed from an adjustment strip that does not stretch, but is flexible perpendicular to the surface of the bottom part of the shaft, which is arranged in a longitudinal slit in the lower part of the shell, in a plane that is inclined relative to the axis of the boot, by means of a tab preferably formed by the counter-bearing, which nevertheless permits high support forces to be absorbed by the counter-bearing, since it can support itself in a longitudinal section in the lower part of the shell via the tab.

According to another embodiment, it is provided that the setting element is coupled with an adjustment drive of the adjustment device, which makes it possible to achieve rapid adjustment of the setting element.

It is furthermore advantageous if the adjustment drive is provided by a threaded spindle with two opposite thread segments, which is mounted in the front flap and coupled with an activation element arranged outside of the front flap, which can be pivoted from an activation position in which it projects relative to the front flap into a rest position, in which it rests against the front flap or is recessed into it, if necessary, since this makes it possible to achieve a change in damping characteristics or spring characteristics of the spring element without manipulation at the front flap and in any desired position of the front flap relative to the lower part of the shell.

Beyond this, it is advantageous if the activation element has different activation positions relative to the front flap, since this makes locking of the activation element possible in simple manner, so that a pre-selected position be maintained even during use of the ski boot, in other words while skiing.

However, it is also possible that the activation element forms the eccentric lever of the coupling device and that the locking tab is mounted so that it can be shifted on the threaded spindle, in the longitudinal direction of the same, and is provided with a ring-shaped groove facing towards the threaded sleeve, into which guide tabs, e.g. push pins, mesh, which are connected to move together with a push rod which can be displaced inside the threaded sleeve in the longitudinal direction, which rod is mounted to rotate on the eccentric lever at its other end, which makes it possible to allow both changes in spring or damping characteristics, as well as locking and unlocking between the spring element and the front flap, with a single common activation element.

Another further development provides that the spring element is connected with a coupling part, in which the bore for the locking tab is arranged, with the bore being penetrated by the threaded spindle of the adjustment device. This makes it possible to transfer great forces from the locking tab to the spring element and unbuckling can be achieved even with a low construction height.

Finally, it is also possible that the spring element is U-shaped or C-shaped and that one shank is connected with the guide plate and another shank, or a base of the C-shaped spring element, is connected to move together with the lower part of the shell, which makes it possible to also use spring elements which have a different structure and a low construction height in connection with the setting device.

For a better understanding of the invention, it is explained in more detail on the basis of the embodiments represented in the drawings.

BRIEF DESCRIPTION OF THE DRAWINGS

FIG. 22: a ski boot in the region of another embodiment of a setting device structured according to the invention for forward position of the front flap, seen in a frontal view, in cross-section;

FIG. 23: the setting device in a side view, in cross-section according to lines XXIII—XXIII in FIG. 22;

DETAILED DESCRIPTION OF THE PREFERRED EMBODIMENTS

Figure 1:
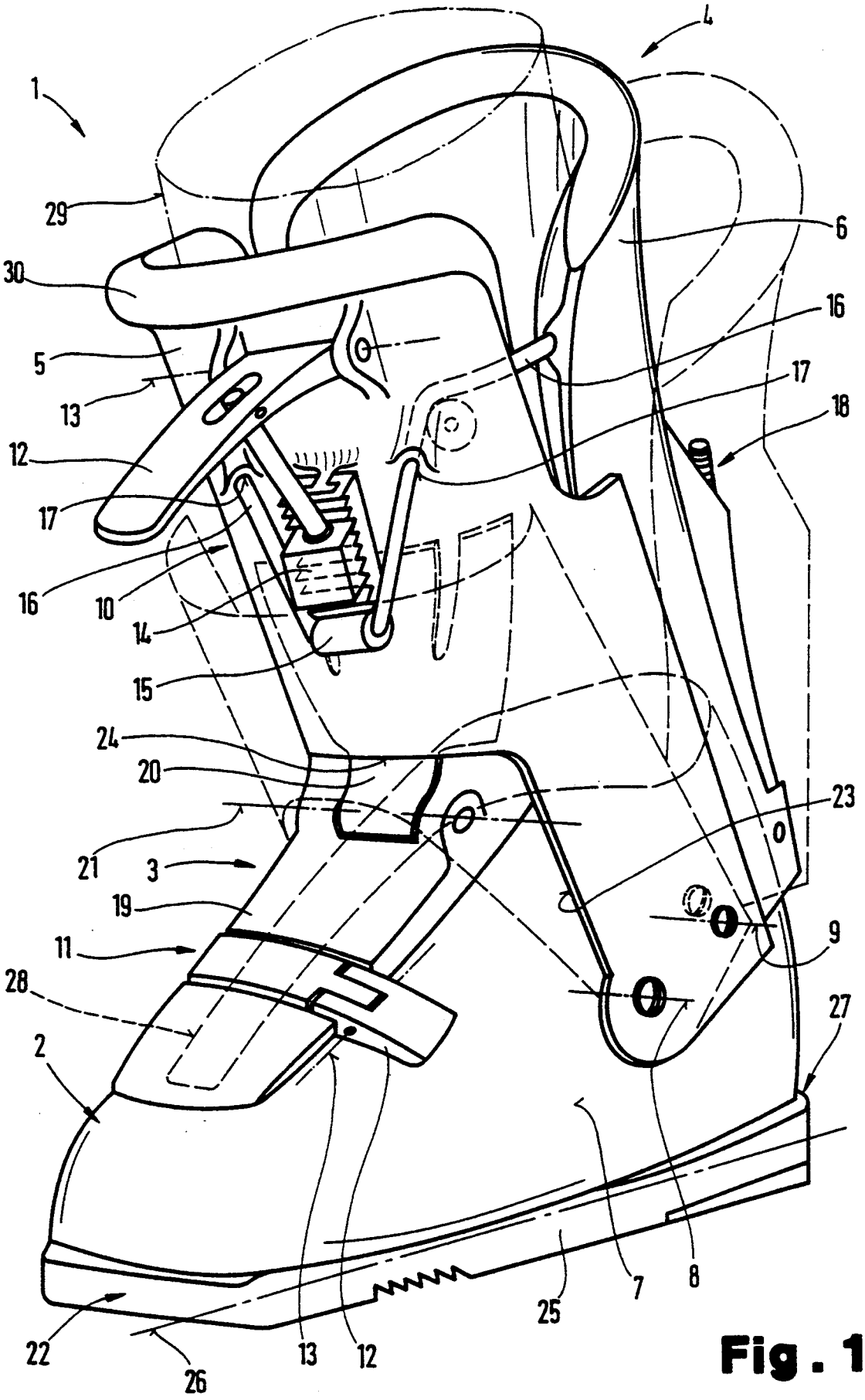
FIG. 1: a ski boot according to the invention, as an illustration.

FIG. 1 shows a ski boot 1 according to the invention, the shell of which consists of a lower shell part 2 and a shell cover 3. A shaft 4 consists of a front flap 5 and a rear flap 6. The front flap 5 is mounted to pivot via pivot axes 8 supported in side walls 7 of the lower shell part 2. The rear flap 6 is connected with the lower shell part 2 with a joint, via its own pivot axes 9, which are also supported in the side walls 7 of the lower shell part 2.

To close the shaft 4, i.e. the lower shell part 2, closure devices are arranged. The closure devices consist of buckle arrangements 10, 11. Each buckle arrangement 10, 11 comprises an activation lever 12, which can pivot around an axis 13. The activation lever 12 of the buckle arrangement 10 is furthermore coupled with a catch 14, which in turn acts together with a ratchet part 15, via cogs, for example counter-gearing. The ratchet part 15 is connected with pulleys 16, which are guided on the front flap by holders formed of holder openings 17 and anchored in the rear flap 6. By adjusting the position of the activation lever 12 from the position projecting forward from the front flap 5, as shown with solid lines, into a position resting against the front flap 5, the pulleys 16 are tightened, which causes the front flap 5 and the rear flap 6 to be locked together in a closed position. A setting device 18 for the forward position is connected with the rear flap 6. As is furthermore evident from this representation, the shell cover 3 consists of a front foot cover 19 and an instep cover 20. The front foot and instep cover 19, 20 can be pivoted relative to one another around an axis 21, which runs approximately parallel to the pivot axes 8, 9. The front foot and instep cover 19, 20 are mounted in a pivot arrangement for this purpose, which has a pivot axis forming the axis 21. This can be supported in the lower shell part 2 or connect only the front foot and instep cover 19, 20. As indicated with broken lines, the instep cover 20 extends into the region above the shin continuation at the foot, in order to allow firm support of the foot in the ski boot.

In order to prevent the instep cover 20 from moving forward in the direction of the boot tip 22 when there is great pressure of the instep against the instep cover, a base of a U-shaped cutout 23 arranged on the front flap 5 is formed as a supporting surface 24.

If the shaft 4, closed by means of the buckle arrangement 10, is moved forward by a relative movement of the lower leg in the direction of the foot, in other words when the skier bends his knees, for example, the pressure of the instep of the carrier of the ski boot on the instep cover 20 increases. This now attempts to move away in the direction of the boot tip 22. With the support surface 24 which overlaps the instep cover 20, excess deformation of this instep cover in the direction of the boot tip is counteracted. This pivot path of the instep cover 20 is designed in such a way that it becomes larger with an increasing forward position and increasing forward movement of the front flap 5. With a suitable design of the U-shaped cutout 23 in the region of the front flap 5, it can furthermore be achieved that when the front flap 5 moves forward, when the buckle arrangement 10 is open, the base of the U-shaped cutout 23 can be pivoted forward into the region of the axis 21. The axis 21 then runs parallel to a sole 25 and vertical to a longitudinal sole direction 26, which is schematically shown with an axis extending from the boot tip 22 into the heel region 27.

As is furthermore indicated with broken lines, the shell cover 3 extends along and above a longitudinal slit 28 of the lower shell part 2, which runs between the boot tip 22 and the heel region 27.

For pressure-free hold of a leg 29, schematically shown with thin lines, an interior shoe 30 of a soft material, for example a porous PU foam with textile and leather lining on the inside and outside, is arranged between the leg 29 and the shell and the shaft 4.

Another advantage of the ski boot 1 as shown is that after the buckle arrangement 10 has been opened, the front flap 5 of the shaft 4 can be moved forward around the pivot axes 8, in the direction of the front buckle arrangement 11, i.e. the boot tip 22, with pivoting of the front flap 5 into the region between the axis 21 and the boot tip being allowed by the support surface 24, corresponding to the arrangement of the pivot axes 8. This makes possible almost completely free mobility of the instep cover 20 around the axis 21, so that when the leg 29 slips out of the ski boot, the instep cover 20 can be pivoted away from the instep region in the direction of the boot tip 22. This makes it possible to eliminate the tension between the instep region and the heel region, which is actually important in a ski boot, so that it is easy to get into and out of the ski boot. In addition, the rear flap 6 can be pivoted to the back around the pivot axes 9—as also indicated with schematic lines—which also releases the heel fixation, and therefore getting into and out of the boot is made even easier. The front flap 5 and the rear flap 6 are therefore adjustable in the longitudinal sole direction 26, in opposite directions, as in a central closure, so that the greatest possible distance between the instep region and the heel region is achieved. When the leg 29 is in the ski boot, in contrast, closing of the front and rear flap 5 and 6 relative to one another pivots the heel adjustment to the heel region and the instep cover 20, via the support surface 24, into the desired position, locking this foot region in place. Therefore a ski boot 1 structured in this way allows central release of the entry region, without complicated pulley mechanism between the individual parts of the front flap 5 and the rear flap 6, and firm hold and fixation of the leg 29 in the ski boot 1.

Figure 2:
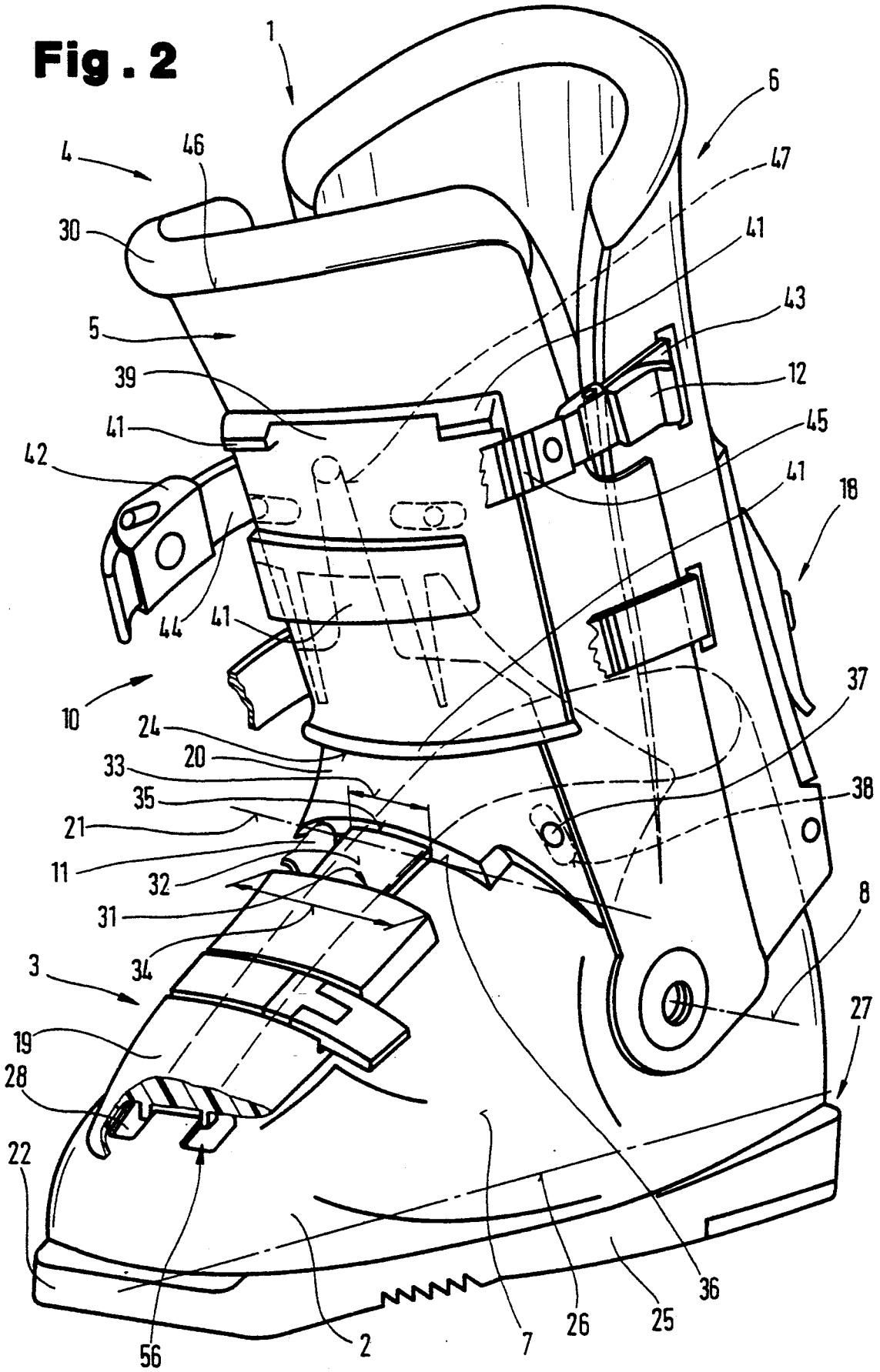
FIG. 2: another embodiment of the ski boot according to the invention, as an illustration.

FIG. 2 shows another embodiment of a ski boot 1. It again comprises a lower shell part 2, a shaft 4 formed of a front flap 5 and a rear flap 6, and an inner shoe 30 arranged inside the lower shell part 2 and the shaft 4. The lower shell part 2 is again provided with a longitudinal slit 28, which extends from the boot tip 22 into the heel region 27. This longitudinal slit 28 is closed off with a shell cover 3, which extends above the longitudinal slit 28. The shell cover 3 consists of a front foot cover 19, which extends from the region of the boot tip 22 to a covered axis 21. From there, the instep cover 21 continues. The axis 21 is formed by a weakening line which runs perpendicular to the longitudinal sole direction 26 and parallel to the sole 25. This weakening line is formed due to the fact that a cross-section of the shell cover 3 between the front foot cover 19 and the instep cover 20 is reduced. For this, the shell cover 3 is provided with a groove-shaped depression 31 in the front foot cover 19. A groove base 32 of the depression 31 has a lesser length 33 than a width 34 of the front foot cover 19 directly adjacent to it. In addition, in the region of this groove-shaped depression, a buckle arrangement 11 is provided, with which the groove base 32 can be fixed in its position relative to the lower shell part 2. In the present case, the weakening line 35 is formed by the transition region, i.e. the edge between the groove base 32 and a groove flank 36. In this way, the instep cover 19 can be pivoted around this weakening line 35 in the longitudinal sole direction 26. In order to ensure pivoting in the desired direction, the instep cover 20 is furthermore connected with guide elements 37, which are guided adjustable in sliding tracks 38 arranged in the side walls 7 of the lower shell part 2, approximately perpendicular to the sole 25. In connection with the structure of the sliding track 38 and in interaction with the weakening line 35, the instep cover 20 can now be pivoted in an approximately circular path around the axis 21.

The movement of the instep cover 20 is limited by the support surface 24, which is arranged on a support plate 39, which in turn is attached to the front flap 5.

The support plate 39 can now be selected in terms of material rigidity, thickness and shape, as required by the stress, since elastic properties, such as those needed for the pivoting front flap 5, for example, are not necessary. Therefore this support plate 39 can be made massive, especially in the region of the support surface 24, so that even at great stress on the instep cover 20, the latter cannot move in the direction of the boot tip 22. However, it is advantageous in this if the support plate 39 is simultaneously used for distribution of the tension forces of the buckle arrangement 10 in the region of the shaft 4. In order to distribute the tension force of the buckle arrangement 10 among the desired regions, the support plate 39 with guide ribs 40, 41 can be used to guide carrier straps 43, 44 which hold the activation lever 12 or a stop element 42, or a catch strap connected with the activation lever 12. Due to the rigid structure of the support plate 39 and a corresponding structure of the U-shaped cutout 23, as well as a slit 47, especially a V-shaped, narrowing one, which extends in the direction of the upper frontal end 46, this support plate 39 can take any desired angled position relative to the lower leg, in adaptation to the progression of the lower leg.

Figure 3:
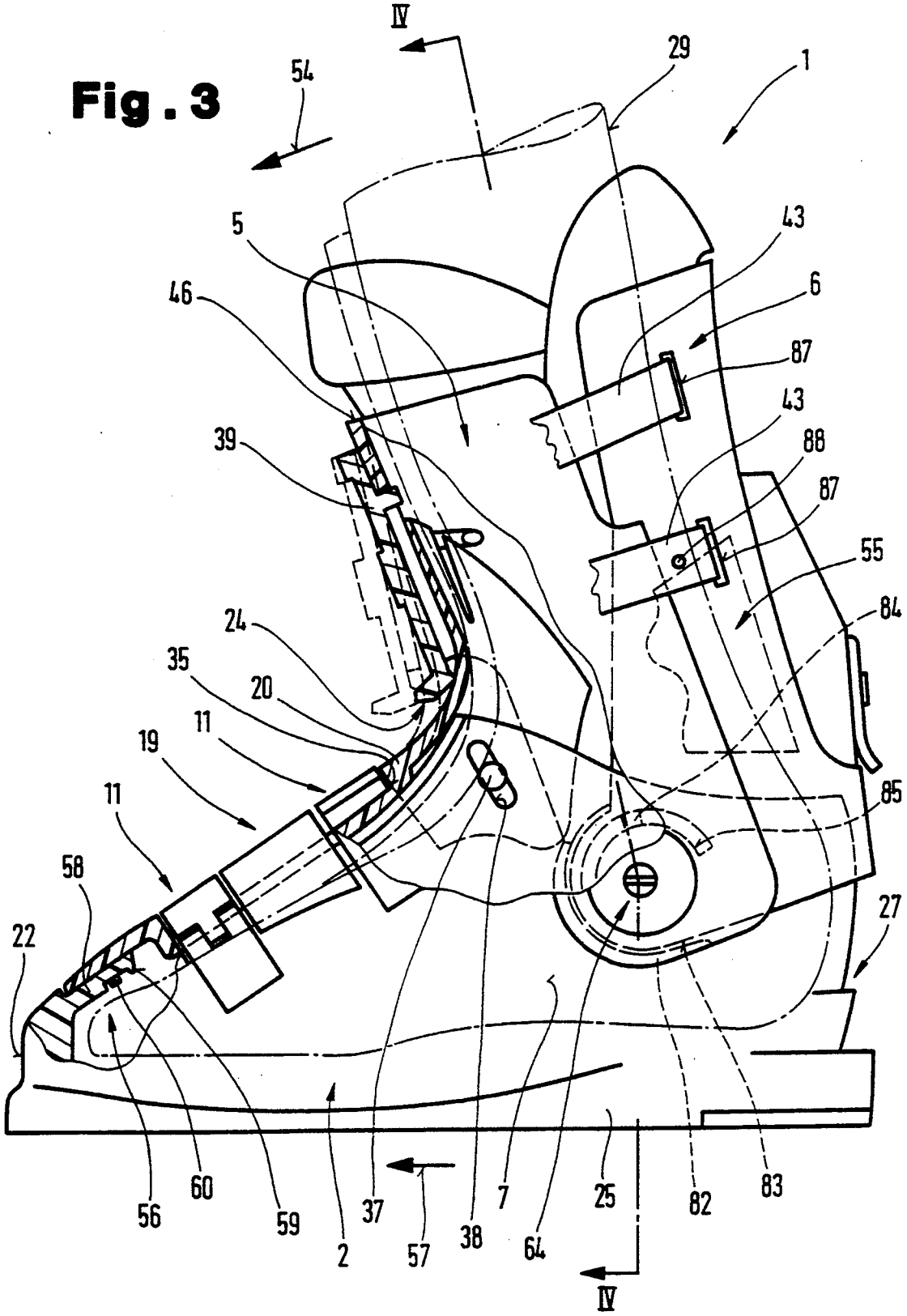
FIG. 3: the ski boot according to FIG. 2 in a side view, in partial cross-section.
Figure 4:
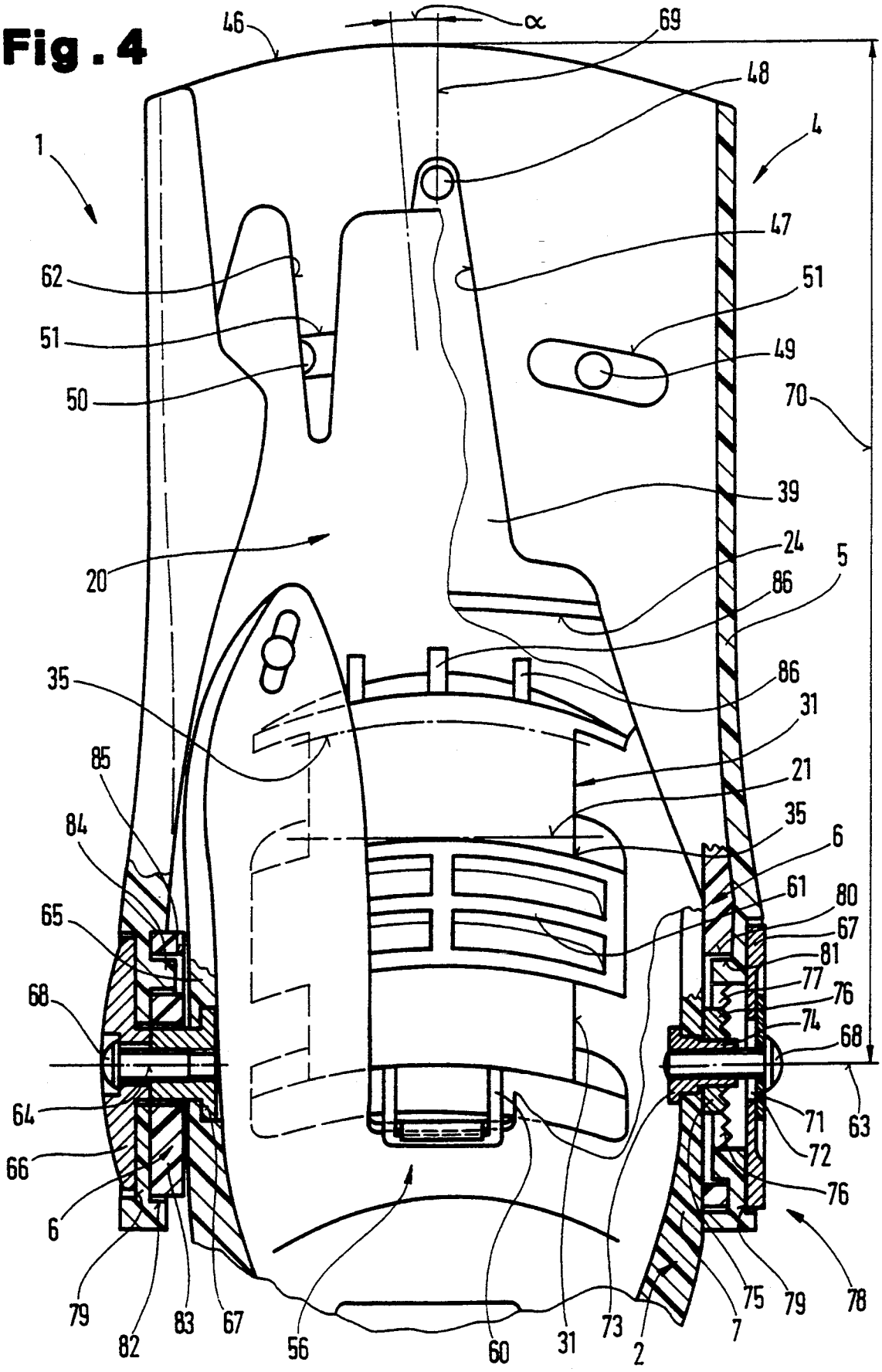
FIG. 4: the ski boot in a frontal view, in a cross-section according to line IV—IV in FIG. 3.
Figure 5:
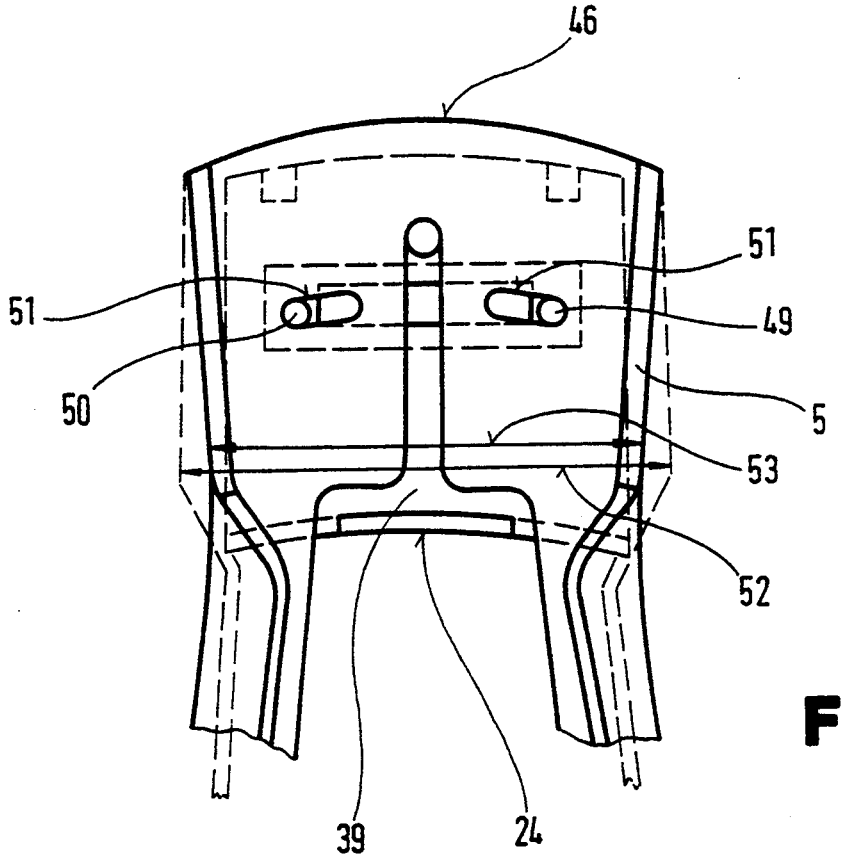
FIG. 5: the front flap of the shaft with the closure device closed, in a frontal view, seen from the interior of the boot.

In FIG. 3 to 5, which show various views of the same ski boot 1 as in FIG. 2, the adaptation of the shaft width in the region of the foot, drawn with thin broken lines in all the figures, is more clearly evident. For example, two different anatomical possibilities are shown in the instep area of the foot, purely schematically and greatly exaggerated in terms of proportions, in order to be more clear, with broken and dotted lines. A foot shape corresponding to the dotted line corresponds to a position of the support plate 39 as shown with solid lines, while a version of a foot corresponding to the broken line, in other words with a high instep and a relatively straight continuation of the shin, corresponds to the position of the support plate 39 shown with broken lines. As can further be seen from this representation in FIG. 3, the support plate 39 acts as an equalizer, as does the instep cover 20, since it takes on the position indicated with broken lines, instead of the position shown with solid lines, which corresponds to the higher instep of the leg 29, for example by bending around the weakening line 35. Fixation of this weakening line 35 in the direction of the boot tip 22 and the height guidance in the lower shell part 2 along the sliding track 38 makes it possible to adjust the position of the instep cover 20 to the instep progression, i.e. the transition between the instep and shin of the leg 29 in question.

This adjustment is also made easier due to the fact that the support plate 39, as can be seen more clearly on FIG. 4 and 5, is supported in the upper end of the V-shaped slit 47, by means of the tab 48, in the direction of the upper frontal end 46. Furthermore, the support plate 39 is mounted to move in guide arrangements 51 which extend on both sides of the U-shaped cutout and/or the V-shaped cross-section 47. As a comparison of the two representations in FIG. 4 and 5 shows, a cross-section of the shaft 4 can be achieved by changing the circumference length of the front flap 5. For example, by tightening the buckle arrangement 10 which is closer to the sole 25, a cross-section width 52, at which the guide tabs 49 and 50 are approximately in the middle of the guide arrangements 51, can be reduced to a cross-section width 53 as shown with solid lines in FIG. 5, with the guide tabs 49, 50 then being in the separated end regions of the guide arrangements 51. By using the guide tabs 49, 50 and the tab 48, which supports this support plate in the direction of the upper frontal end 46 of the front flap 5, the adjustment can take place according to a pre-determined spacial guide path. This prevents undesirable tension or deformation of the front flap 5. The reduction in cross-section width 52 to the cross-section width 53 is made possible by the fact that the two flanks of the V-shaped slit 47, as is evident from FIG. 5, are brought into a parallel position relative to one another. Because of the fixed cross-section width 52, in the region of the upper frontal end 46, deformation only takes place in the region which lies closer to the transition region between the shin and the instep, in which people are known to have different, in some cases very different foot cross-sections, for anatomical reasons. The advantage of this solution lies in the fact that a lesser cross-section width 53 in the region of the buckle arrangement 10 which lies closer to the support surface 24 practically does not increase the tension in the region of the buckle arrangement 10 which lies closer to the upper frontal end 46. In the ski boots used until now, the lack of flexibility of the front flap 5 results in non-exact adjustment of the ski boot to the transition region between the instep and the shin, which means that the shin of a skier bending his knees presses against the upper frontal end 46 of the front flap 5, i.e. that greater surface pressures than desired occur there, and that this pressure is often felt to be uncomfortable and often results in stress on the skin surface (bruises, blisters). In this regard, this support plate 39 has not only a support function with the support surface 24, but also a function to transfer tension forces to a large area of the shin region, which is achieved by a corresponding structure of the support plate 39 and the front flap 5. Further advantages of this structure result from the interaction of the support surface 24 with the instep cover 20, by the pivoting of the instep cover 20 around the axis 21 as seen in FIG. 4, or the weakening line 35 in the edge region of the depression 31. If the lower part of the leg 29 is pivoted forward in the direction of an arrow 54, around the ankle, e.g. when the skier bends his knees, stress release automatically occurs in the heel region, 27, i.e. the heel has the tendency to be raised up from the sole 25, which results in greater stress on the instep cover 20 by the instep of the leg 29. Under stress, the instep cover 20 now tries to move away in the direction of the support plate 39, but is held back from this by the support plate 39, because the support surface 24 is moved forward to an extent corresponding to the forward movement of the front flap 5. This prevents the leg 29, i.e. the heel from rising too far from the sole 25, or from slipping out of the setting device 55 for holding the heel or adjusting it in the region of the Achilles tendon, as indicated with broken lines, and thereby losing the lateral guide of the leg 29 relative to the ski boot 1. A loss of this fixation would mean that the rotational movements of the leg 29, for example when making a turn, could no longer be transferred to the skis to the necessary extent, which would impair the ski control. Due to the increased resistance which is provided against deformation of this instep cover 20 by the support plate 39 and the support surface 24, transfer of the rotation movements of the leg 29 to the ski is promoted.

It is also important that the instep cover 20 is fixed in the longitudinal direction—arrow 57—of the ski boot 1, via the front foot cover 19 and a holder device 56.

This holder device consists, as shown in FIG. 2 to 4, of a bracket 58 molded onto the lower shell part 2 at its end facing the heel region 27, with a catch dog 59. This can also be molded on in one piece with the bracket 58. On the bracket 58, a holder stirrup 60 of the holder device 56 is supported, which prevents further slip in the direction of the boot tip 22. The front foot cover 19 is prevented from being pulled out, i.e. pulled off from the lower shell part 2. However, this holder device 56 is quite flexible for pivoting perpendicular to the sole 25. When the buckle arrangements 11 are open, the front foot cover 19 can be moved up with the instep cover 20, for better access and to make it easier to get into and out of the boot. When getting in or out, the full length of the sliding track 38 in the lower shell part 2 can be utilized, if the guide element 37 which is connected with the instep cover 20 is moved to the upper region of the sliding track 38. Due to this mobility of the holder device 56, it is not necessary to apply the full range of movement in the sliding track 38 by the weakening line 35, i.e. in the region of the axis 21; instead, especially when opening the ski boot, part of the pivot movement of the shell cover 3 can take place via the holder devices 56, as will be explained in more detail on the basis of FIG. 9, when the buckle arrangements 11 are open.

The representation in FIG. 4 furthermore makes it clear that to reinforce the front foot cover 19 between the depressions 31 for the buckle arrangements 11, the raised sections can be reinforced by internal ribs 61.

The end of the instep cover 20 facing towards the upper frontal edge 46 is provided with V-shaped slits 62, so that in case of deformation of the front flap 5 during narrowing of the cross-section width 52 or 53, the flap can adjust to different cross-sections, without folding or causing point pressure in the region of the shin.

In the lower part of FIG. 4, the arrangement of the front flap 5 and the rear flap 6 on pivot axes 63, 64 is also shown. The pivot axis 63 is attached in the side wall 7, and the pivot axis 64 is attached in a side wall 65 of the lower shell part 2. The pivot axis 64 is formed by an outer holder disk 66 and an interior anchoring disk 67. In the passage bore, a screw 68 is inserted, which is threaded into the interior thread of the anchoring disk 67 and holds the holder disk and the anchoring disk 67 tightly together. Due to the fact that the holder disk 66 and the anchoring disk 67 abut with their frontal surfaces, the screw 68 can be tightened as much as desired, still leaving sufficient freedom of movement for the front flap 5 and the rear flap 6 relative to the lower shell part 2.

The pivot axis 63 is formed relative to the canting adjustment of the shaft 4 relative to the lower shell part 2, i.e. the sole 25. This canting adjustment, with which a shaft axis 69 can be adapted to the anatomical conditions of a leg 29, comes about in that a distance 70 between the pivot axis 63 and the upper frontal end 46 is changed in the region of the side wall 7. This makes it possible to pivot the shaft axis 69, as shown with double dotted lines in FIG. 4, around an angle, either in the direction of the side wall 7 or in the direction of the side wall 65. This allows simple adaptation of the geometry of the ski boot 1 to people with knock knees and bow legs. A holder disk 71 is provided with a longitudinal hole 72 for this purpose, in which the screw 68 is guided to move. An anchoring disk 73, which has an inner thread, similar to the structure of the anchoring disk 67, has a tab 74 which projects in the direction of the holder disk 71, on which a tension plate 75 is guided, which has gear teeth 76 on its end facing the front flap 5.

The gear teeth 76 of the tension plate 75 have a guide slit 77 for the tension plate 75 assigned to them, in the surface of the front flap 5 facing them, the surface of which is also provided with gear teeth 76.

Adjustment of the shaft 4 relative to the lower shell part 2 with a setting device 78 consisting of the aforementioned parts, for lateral incline of the shaft 4, is now carried out as follows: The screw 68 is taken out of the anchoring screw 73 far enough so that the tension plate 75 and the front flap 5 no longer mesh. Then the front flap 5, together with the holder disk 71 mounted in a recess 79 of the flap, can be adjusted in the direction the lower shell part 2, or in the direction of the upper frontal end 46. If the desired angle which best corresponds to the anatomical conditions of the foot has been reached, the desired position can be fixed in place by tightening the screw 68 and locking the gear teeth 76 together. To simultaneously adjust rear flap 6 together with the front flap 5, a guide bore 80 is arranged in the rear flap 6, which is mounted to rotate in ring-shaped continuation 81 of the front flap 5. This brings the rear flap 6 along with the screw 68 when it is adjusted, so that edge mismatch of these two flaps is avoided.

Of course, the holder disk 66 can be guided in a depression 79, so that parts projecting beyond the surface of the front flap 5 are avoided. In the same way, the rear flap 6 can also be guided in the front flap 5 in the region of the pivot axis 64, in that the rear flap 6 is provided with a guide web 82, to which a circular counterpart 83 of the rear flap 6 is assigned. In addition, a stop 84 is molded onto the front flap 5, which is guided in a slit 85 of the rear flap 6. With this slit 85, the maximum relative movement of the front flap 5 and the rear flap 6 to one another is limited. The arrangement of the slit 85 as well as the stop 84 assigned to it is furthermore also evident from FIG. 3.

FIG. 4 furthermore shows that the instep cover 20 can be provided with reinforcement ribs 86, which are adjacent to the weakening line 35, so that pivoting of the instep cover 20 relative to the front foot cover 19 actually takes place only in the region of the weakening line and not in the immediately adjacent regions.

Furthermore, passages 87 are provided in the rear flap 6, in which a carrier strap 43, which can be connected with an activation lever 12 or a catch strap 45, penetrates the rear flap 6. As is shown in the area of the carrier strap 43 closer to the sole 25, this can be fixed in place by means of a fixation pin 88, to prevent movement relative to the rear flap 6.

Figure 12:
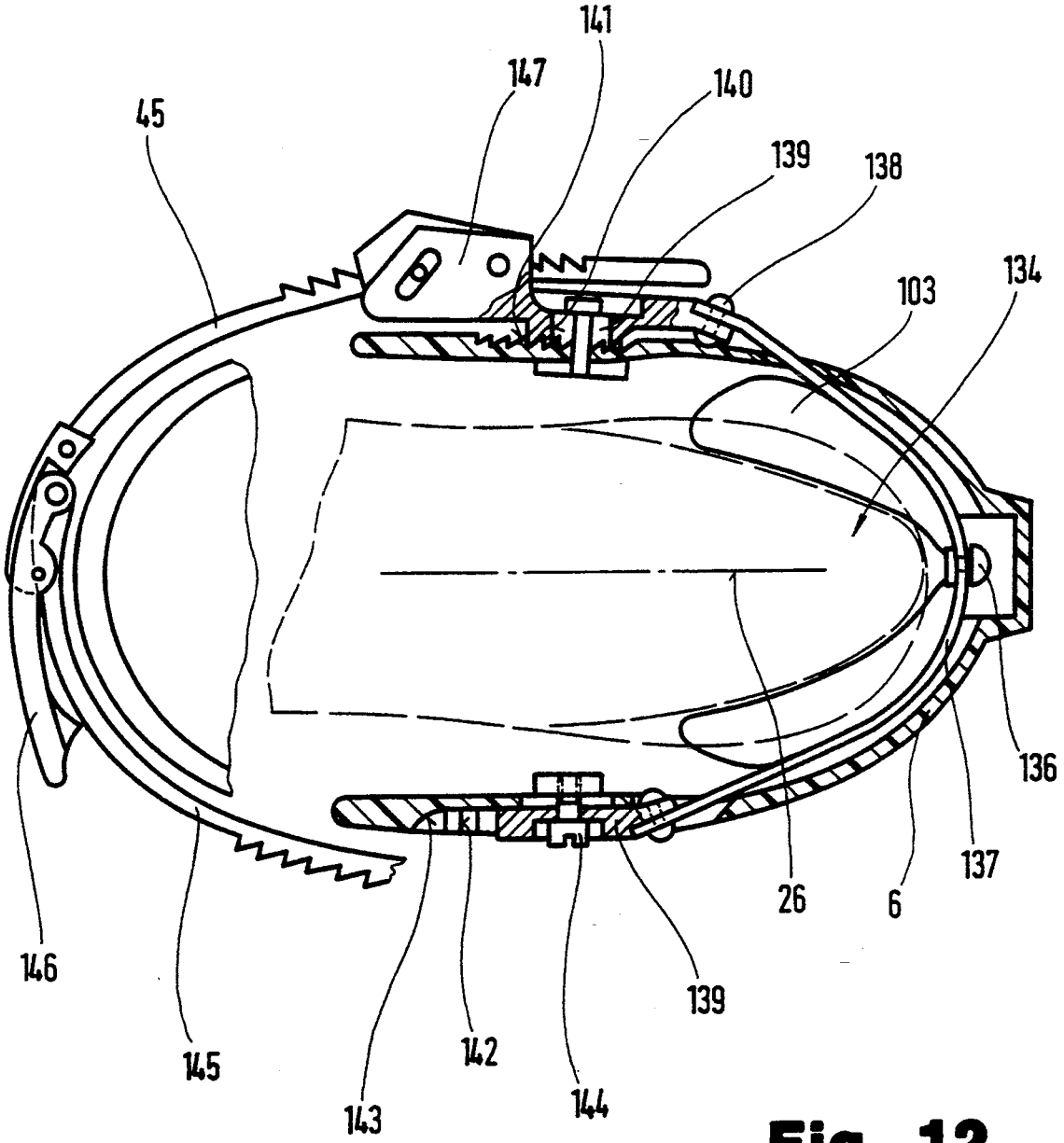
FIG. 12: the rear flap of the shaft with the setting device for heel adjustment arranged in it, in a top view, in cross-section.

Of course it is also possible to attach this fixation pin so that it is not visible from the outside, but rather on the inside of the rear flap 6, with this fixation being especially important if the carrier strap 43, as shown in FIG. 12, for example, passes through the rear flap 6 and is connected with a stop strap or a locking element 42 in the region of the opposite side wall.

Figure 6:
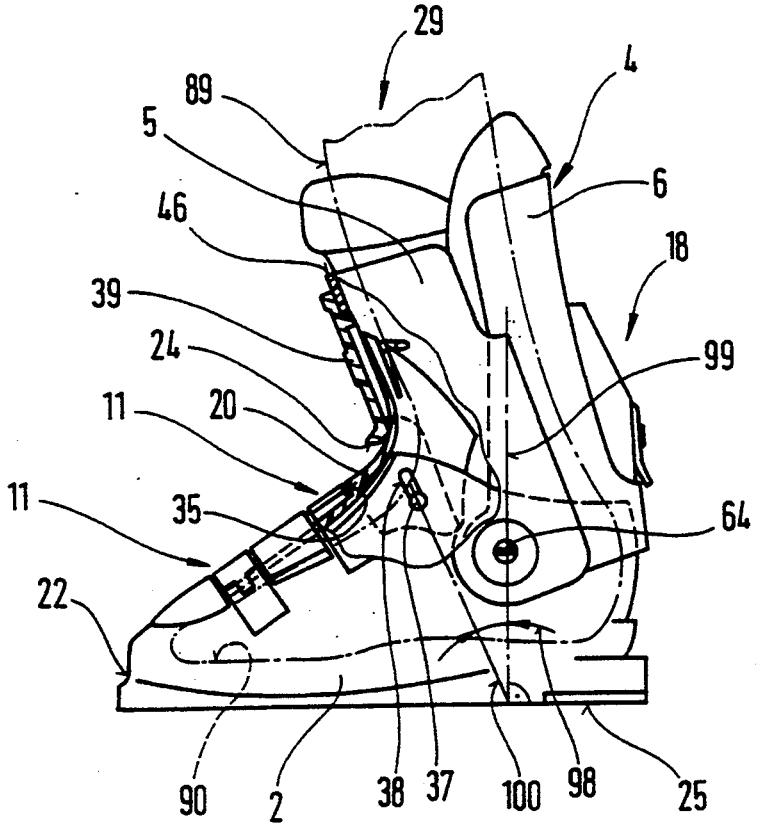
FIG. 6: the ski boot according to FIG. 2 to 5 in a side view, with the shaft closed in the rear forward position.
Figure 7:
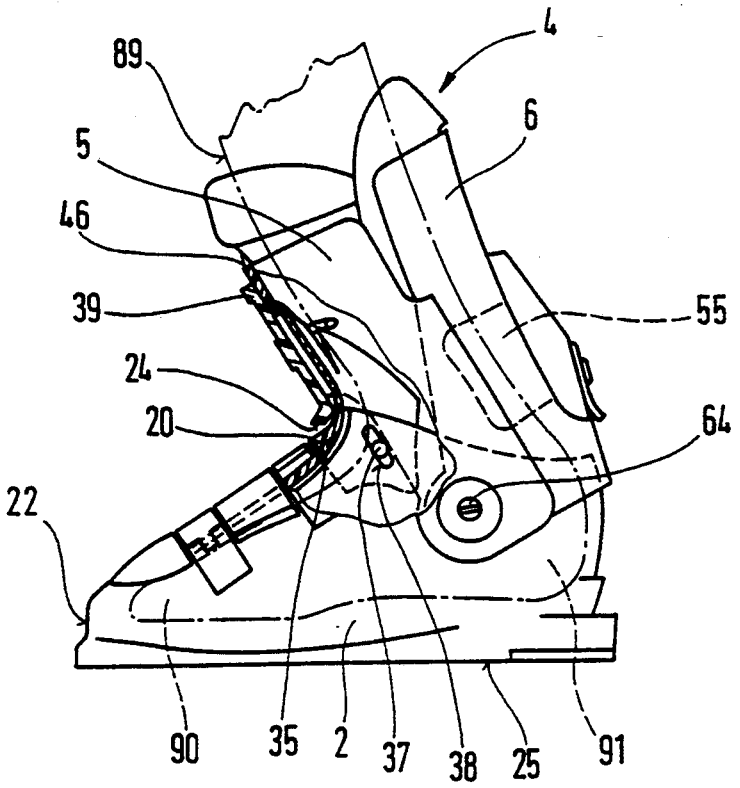
FIG. 7: the ski boot according to FIG. 2 to 5 in a side view, with the shaft closed in the middle forward position.
Figure 8:
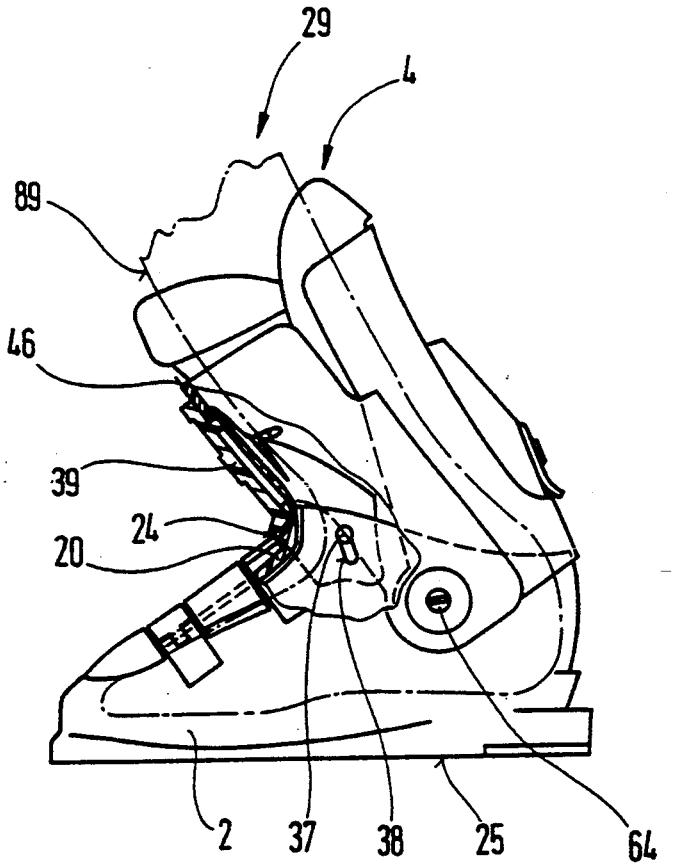
FIG. 8: the ski boot according to FIG. 2 to 5 in a side view, with the shaft closed in the front forward position.

FIG. 6 to 8 show different positions of the shaft 4 relative to the lower shell part 2. In these different positions, it is assumed that the setting device 18 for the forward position is set to its maximum range of movement, so that the entire pivot path of the shaft 4 relative to the lower shell part 2 can be utilized. It should be stated in this connection that the version of the ski boot in FIG. 6 to 8 corresponds to the one as described in detail in FIG. 2 to 5. Furthermore, the buckle arrangements 10 were left out and the front flap 5 was shown in partial exploded view, in order to better show the various relative positions between the instep cover 20, the support plate 39 and the lower shell part 2. It is assumed in this that during these movements, the buckle arrangements 10 remain closed and tightened.

FIG. 6 shows the shaft in its rear end position, in which the lower leg 89 therefore demonstrates only a slight forward position relative to a foot 90. In this position, the guide element 37 is in the region of the sliding track 38 which is closest to the sole 25, since the instep cover 20 is pushed back over the support surface 24 of the support plate 39 and held in this position, which also results in perfect guidance of the leg 29, i.e. the transition region between the lower leg 89 and the foot 90. If the forward position of the lower leg 89 is now increased, as shown in FIG. 7, the pressure of the lower leg 89 on the front flap 5 increases, which pivots the shaft 4 and moves the support plate 39 in the direction of the boot tip 22. This also gives the instep cover 20 the possibility of moving away under the pressure in the instep region, i.e. in the transition region between the foot 90 and the lower leg 89.

FIG. 7 shows the ski boot in a greater forward position of the leg 29 as compared with FIG. 7. The guide element 37 is in a position more distant from the sole 2, in the sliding track 38. Because of the effect of the supporting surface 24, however, the instep cover 20 is only given as much freedom of movement as is absolutely necessary for bending the lower leg 89 forward relative to the foot 90. The lower leg 89 can move, but at the same time, the foot 90 cannot move so far forward in the instep region that the heel 91 is lifted up from the sole 2 for example, or can slip out of a setting device 55 for holding the heel 91 in the region of the Achilles tendon. Release of the movement of the instep cover to the anatomically necessary extent, by the support surface 24 which shifts corresponding to the forward angle of the lower leg 89, therefore allows perfect hold of the foot 90 in the lower shell part 2, even in the extreme forward position as shown in FIG. 8, so that even in this situation, perfect transfer of the rotation movements of the leg 29 to the ski connected with the ski boot 1 is possible.

FIG. 8 shows an extreme forward position of the lower leg 89 of the leg 29. As is evident, the support plate 39 and the instep cover 20 are moved extremely far forward, but as the dotted line which shows the leg 29 in the instep region makes clear, sufficient guidance and stabilization of the instep cover 20 exists, even with the extreme forward position, due to the support surface 24. The instep cover 20 is in its uppermost, farthest position from the sole 25 of the ski boot, as can be seen from the sliding track 38 and the guide element 37. Because of the spacially defined displacement of the instep cover 20, due to the guidance of the guide elements 37 in the sliding track 38, in interaction with the weakening line 35, the instep cover can move in the direction of the upper frontal end 46 of the front flap 5, as the lower leg 69 moves forward further, as is evident from a comparison of FIG. 6 to 8. This prevents a bend in the instep plate 20, which would produce an undesirable pressure point on the leg 29, i.e. in the instep region, in the interior of the shoe, in other words in the region of the support surface 24.

Figure 9:
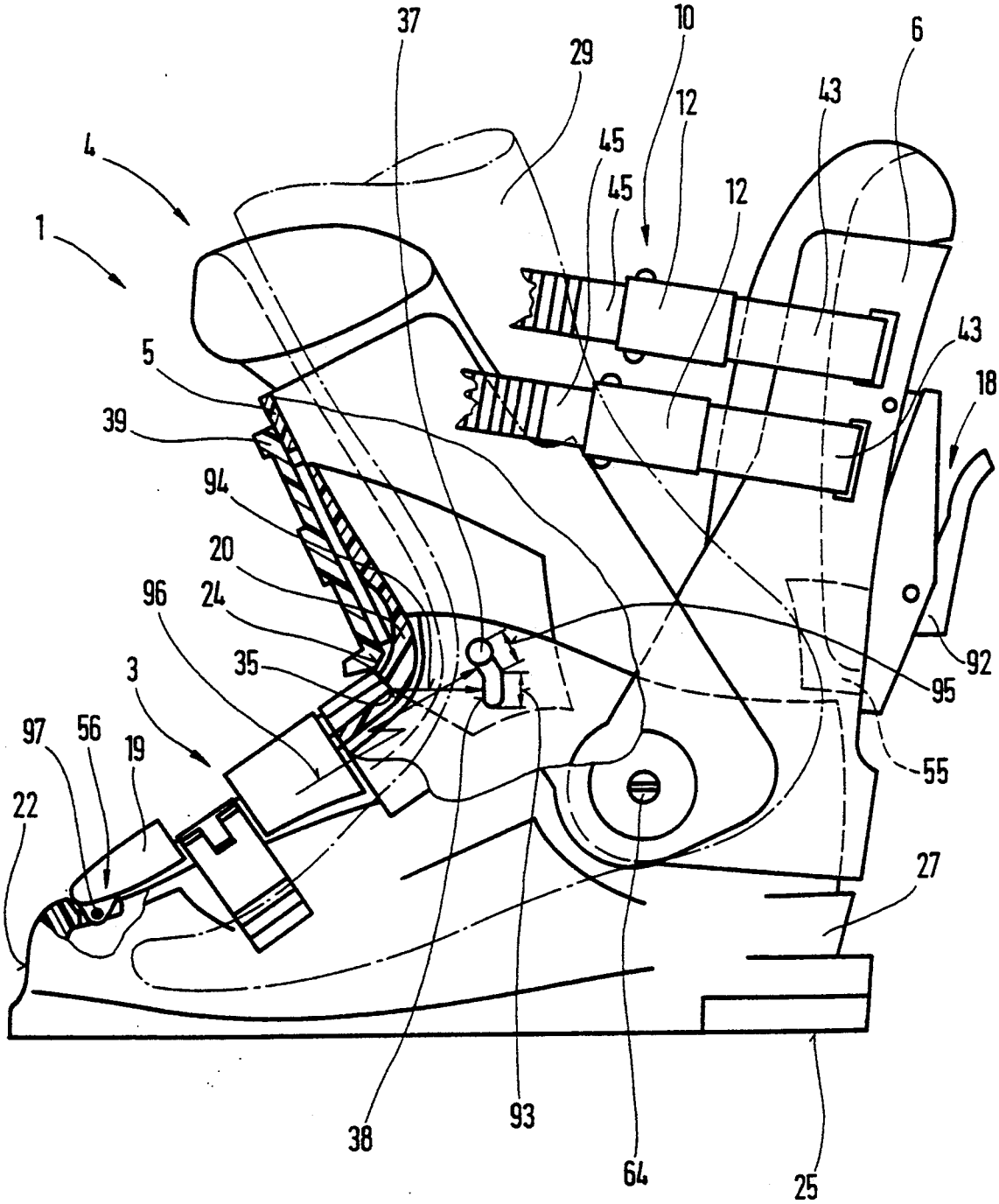
FIG. 9: the ski boot according to FIG. 2 to 8 in a side view, with the shaft opened, in partial cross-section.

FIG. 9 shows the ski boot 1 according to FIG. 2 to 8 in its open position. The buckle arrangements 10, of which the carrier strap 3 as well as the catch strap 45 and the activation lever 12 can be seen, is open and the front flap 5 and the rear flap 6 are pivoted to the maximum end position, both in the direction of the boot tip 22 and in the direction of the heel region 27. The leg 29 is shown in a position in which it must pass through the narrowest cross-section between the instep cover 20 and the setting device 55 for the heel adjustment. Here it proves to be advantageous that the support plate 39 releases the movement of the instep cover all the way into the region of the weakening line 35, because of the central opening—the front flap 5 and the rear flap 6 can be pivoted to approximately the same extent—so that because of the force exerted on the instep cover via the instep of the foot moves it to its uppermost position, at the farthest end of the sliding track 38 from the sole 25, until the guide element 37 comes to a stop. Unlocking of the instep cover 20 takes place when the front flap 5 is opened, by means of the pivoting of the support plate 39 which takes place at the same time, so that the support surface 24 no longer meshes. To the same extent, the setting device 55 is moved into its farthest position relative to the instep cover 20, by pivoting the rear flap 6 backward. As is evident, no additional mechanical parts, pulleys, etc. are necessary to bring about this release of the instep cover 20 and the release of the setting device 55, rather this release necessarily takes place due to the arrangement and assignment of the individual parts of the ski boot, in the logical manner as described above.

The arrangement of the pivot axes 63, 64 in the region of the ankle axis proves to be particularly advantageous, since the shaft 4 can be opened centrally viewed from this region. On the other hand, it is evident from the representations in FIG. 6 to 8 that with this agreement between the location of the ankle axis and the pivot axes 63, 64, a movement of the shaft 4 which is most closely adapted anatomically to the movement of the lower leg 89 is achieved, and that therefore the friction forces and resistances in the boot relative to pivoting of the shaft 4 can be reduced. As is furthermore shown in this figure, the setting device 18 is also shown for fixing the forward position of the shaft 4 in its open position, for which purpose a locking lever 92 is pivoted into an open position. The operation of this setting device will be explained in more detail below, on the basis of FIG. 10.

An advantage of this embodiment of the ski boot according to the invention is also, however, that because of the assignment of the support surface 24, the latter surrounds the instep cover 20, so that the latter can be made relatively flexible, soft and elastic in its region adjacent to the weakening line 35. Adjustment along the desired spacial adjustment path, however, is nevertheless precisely fixed by the weakening line 35, the guide elements 37 and the support surface 24. At the same time, the support surface 24 forms a tight seal between these parts over the entire range of movement when the shaft 4 is closed, in interaction with the instep cover 20, so that no snow or similar material can penetrate into the interior of the ski boot 1 in this region.

This flexibility and elasticity has the further advantage that the instep cover 20 still has a certain flexibility, especially for getting the leg 29 in and out, even if the guide elements 37 are at the end of the sliding track 38, because of its inherent elasticity.

In order to achieve a corresponding movement path for the different movement conditions of the instep cover 20, it is shown in FIG. 9, for example in deviation from the guide tracks 38 in FIG. 2 to 8, that this guide track can be bent according to different radii, with one segment 93 being bent in a radius 94, the center point of which is formed by the weakening line 35. A subsequent segment 95 is bent according to a radius 96, which corresponds to a distance between the sliding track 38 and an axis 97, around which the front foot cover 19, i.e. the shell cover 3 can be pivoted. This axis. 97 is formed by the holder device 56 for the shell cover 3 relative to the lower shell part 2. This causes the instep cover 20 to first be deformed to a maximum extent in the region of the weakening line 35, when the support plate 39 is pivoted far out, and due to the resulting release between the support plate 24 and the instep cover 20, until the guide element 37 moves in the segment 93, and then subsequently, the instep cover is guided in the segment 95, while the entire shell cover 3 is raised around the axis 97.

Furthermore, it should be stated that an angle 98 between a perpendicular line 99 to the sole 25 and a center axis 100 of the sliding track 38, as can be seen, for example, in FIG. 6, encloses a slight angle, for example preferably between 5° and 35°, especially preferably 15°. This angle 98 is achieved when the shaft is in the rearmost position, when the buckle arrangements 10 are closed, with the guide element 37 most often resting against the end region of the sliding track 38 closest to the sole 25, in this case.

Figure 10A:
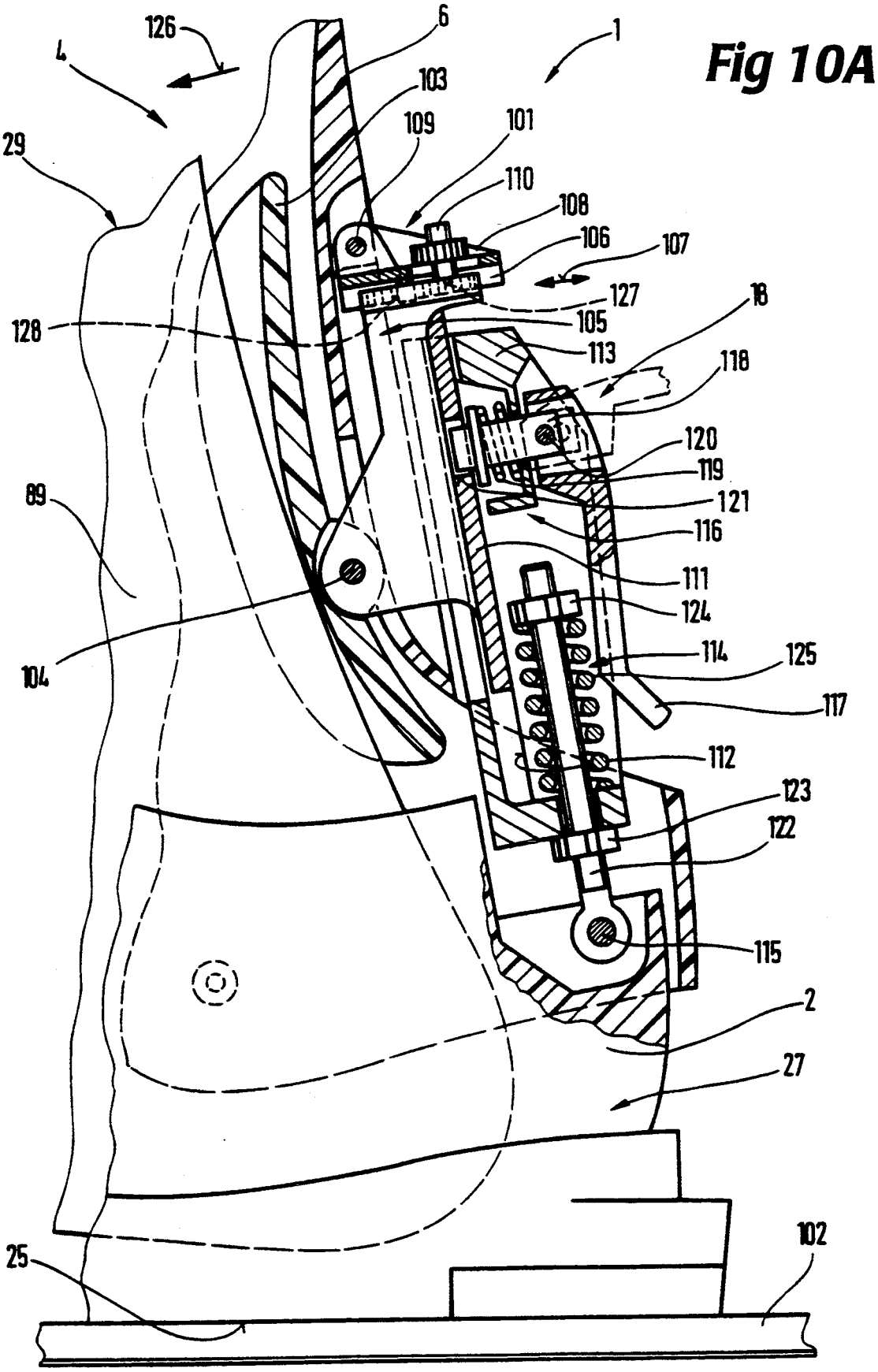
FIGS. 10A–10G: the rear flap of the shaft with the setting device arranged on it for forward position incline, in a side view, in cross-section.
Figure 10B:
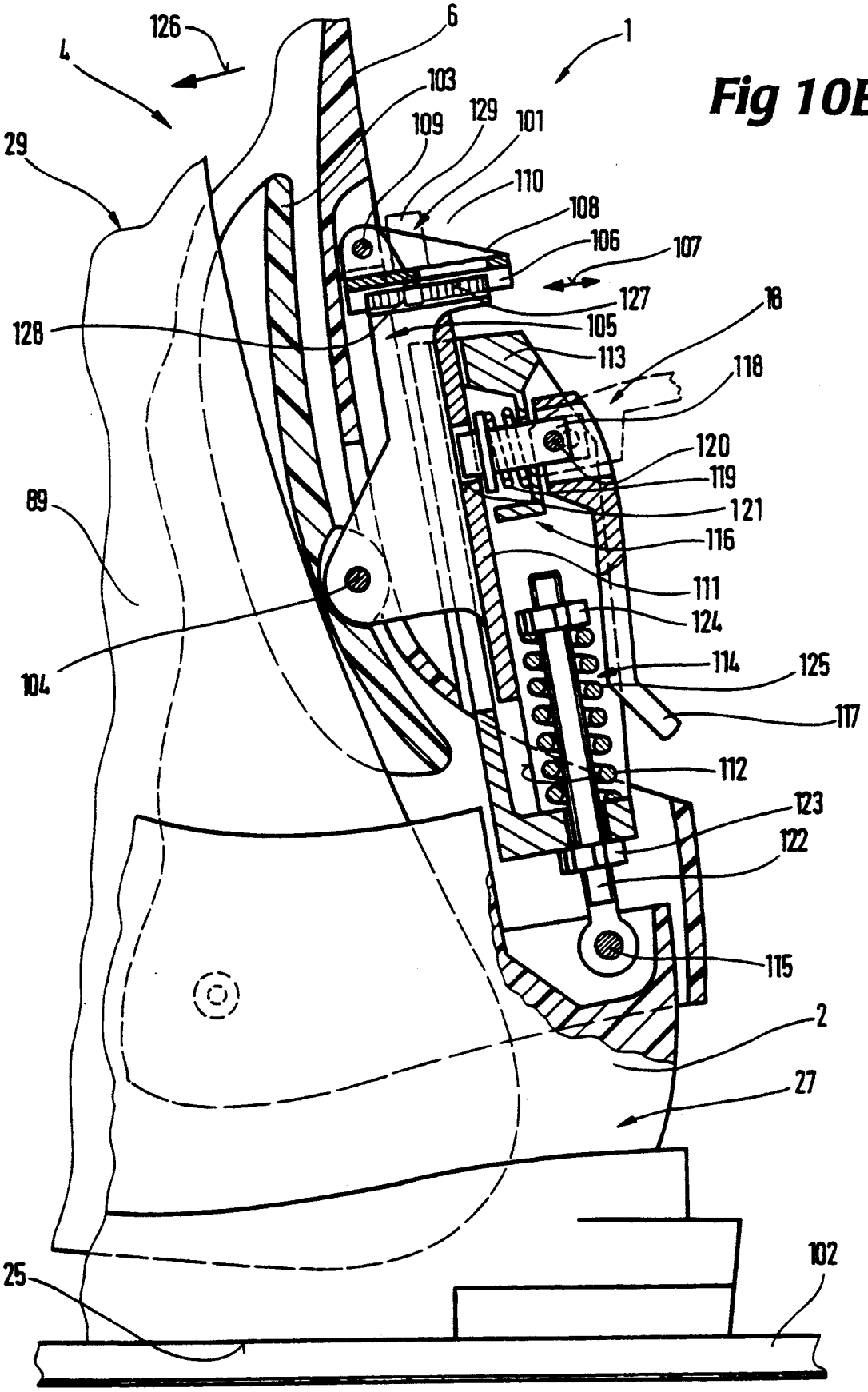

FIG. 10A shows the setting device 101 for adjustment of the forward position of the shaft 4, of which only the rear flap 6 can be seen, on an enlarged scale. This setting device 101 is intended to hold the leg 29 in the heel region 27, so that the leg is held in place between the heel region and the instep. This hold is supposed to ensure that rotation movements of the leg 29 are precisely transferred to the ski boot 1, so that these movements can be passed on to a ski 102 attached to the ski boot 1. For this purpose, a support bracket 103 is arranged in the continuation region of the Achilles tendon, just above the heel, which is mounted in a rotation axis 104 which runs approximately parallel to the sole 25 of the ski boot and perpendicular to the longitudinal sole direction, in order to adjust to different angles. This rotation axis 104 is attached in a housing part 105 of the setting device 101 for forward position. The housing part 105 is mounted to be adjustable in a guide 106, in the direction of the arrow 107. The bearing element 108 can rotate about an axis 109, in which the rear flap 6 is arranged. Furthermore, a fixation device 110 is provided on the bearing element 108, which has a screw bolt, which can be adjusted perpendicular to the guide 106 by means of a setting wheel, and to which the housing part 105 can be fixed in position relative to the bearing element 108. The housing part 105 has a guide plate 111, which forms a guide device together with guide slits 112 in a housing 113 of the setting device 101. Via a damping device 114, the housing 113 is supported to pivot on an axis 115 in the lower shell part 2. In order to fix the housing part 105 and the housing 113 in a certain position relative to one another, in which the rear flap is in its most rearward position—as shown in FIG. 6, for example—a coupling device 116, which can be opened, is provided. This consists of an eccentric lever 117, a locking tab 118 and a pressure spring 119, which is formed as a spiral spring in the present case. The eccentric lever 117 is mounted to rotate on the pivot axis 120 which passes through the locking tab 118. By pivoting the eccentric lever 117 from the position shown with solid lines, in which the locking tab 118 meshes with a bore 121 of the guide plate 111, into the position shown with broken lines, in which it is pivoted up, the locking tab 118—as is also shown with broken lines—is pulled out of the bore 121. This causes the housing part 105 with the guide plate 111, the movements of which are controlled by the former, to be freely movable along the guide slit 112, circumventing the damping device 114. This makes it possible to pivot the rear flap 6 into any desired position relative to the lower shell part 2. If, however, the locking tab 118 is resting in the guide plate 111, the housing 113 and the housing part 105 form a rigid unit, the position of which is fixed by a stop 123, which can consist of an adjustable nut, arranged on a threaded rod 122. The threaded rod 122 is provided with a bearing eye molded or screwed onto it, in the present case, which rests on the axis 115. Due to the effect of the damping device 114 formed by the threaded rod 122, the stops 123 and 124, as well as a pressure spring 125, the housing 114 is held in the rest position as shown with solid lines. If the shaft 4 is moved forward in the direction of an arrow 126, while the shaft is closed, in other words the lower leg 89 moves in the direction of the boot tip 22 when the skier bends his knees, this forward movement is delayed, i.e. damped by the pressure spring 125. Depending on the spring characteristics of this pressure spring, which can be formed of a spiral spring, the resistance to be overcome is greater or less. Furthermore, the damping characteristics of the pressure spring 125 can be increased by means of the stop 124, in other words by turning the nut in direction of the stop 123, or reduced by turning it in the opposite direction. At the same time, by adjusting the stop 124 the adjustment for limiting forward position which is located opposite the stop 123 can also be established. This results from the length dimension of the compressed pressure spring 125 and the position of the stop 124.

Figure 10C:
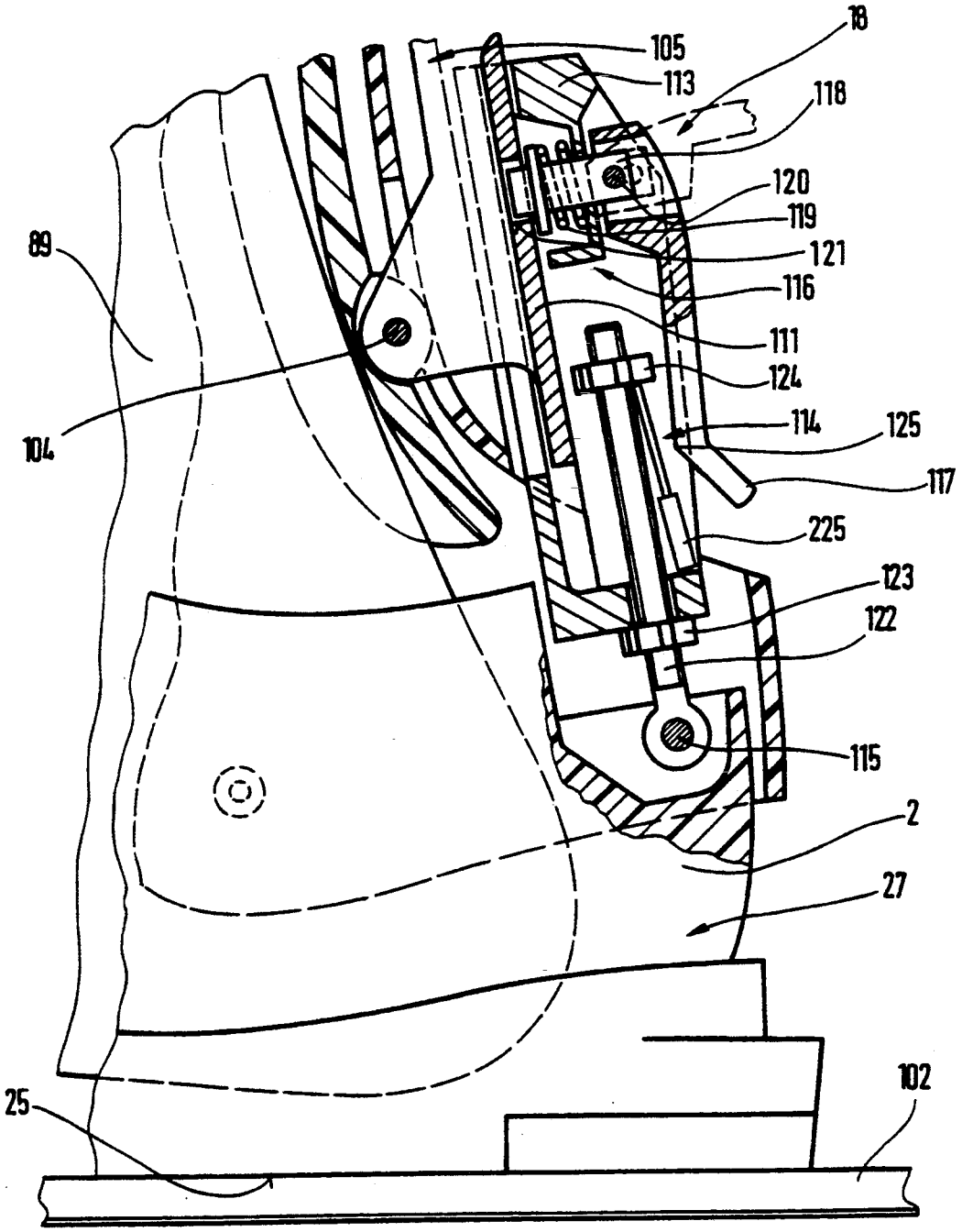
Figure 10D:
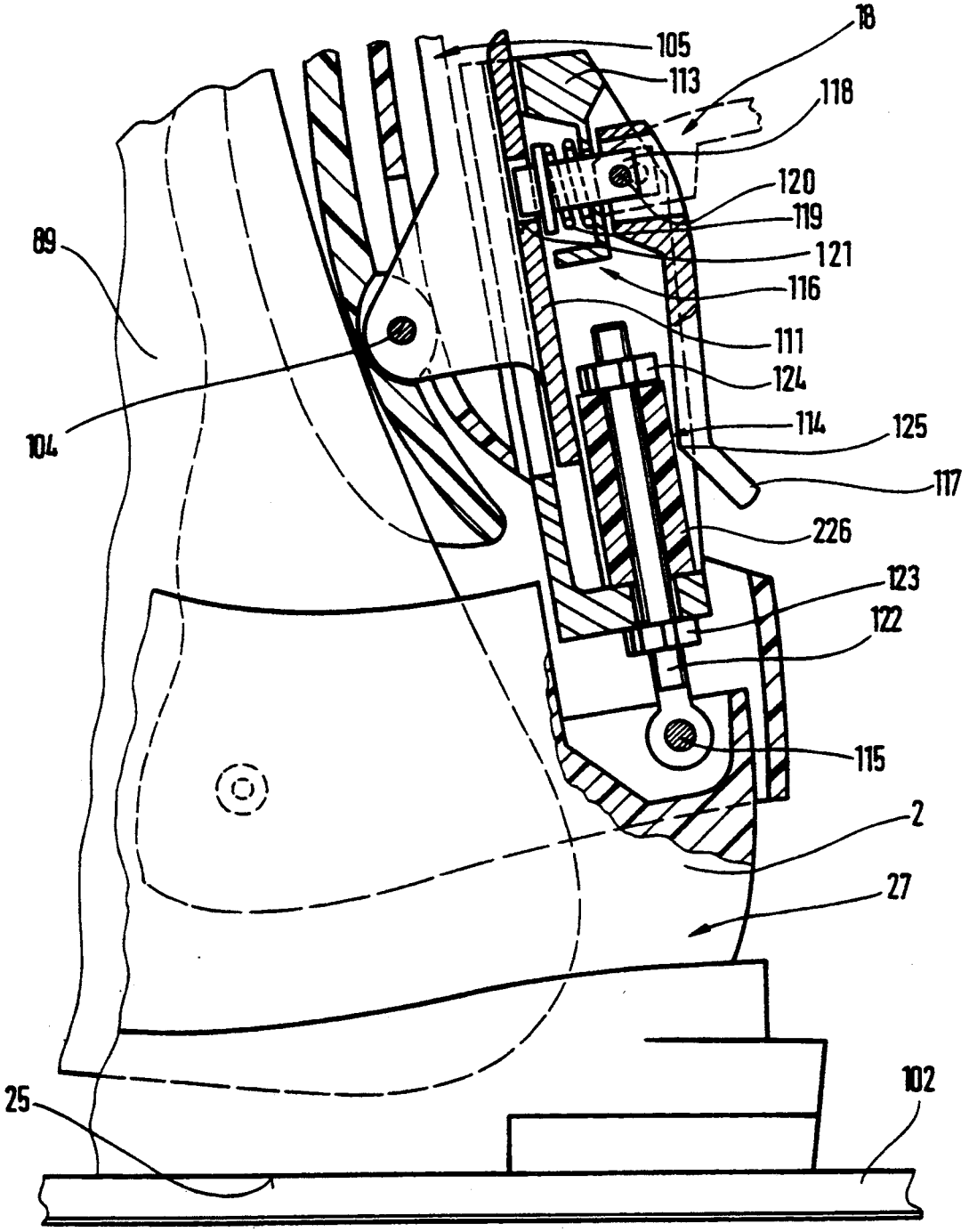
Figure 10E:
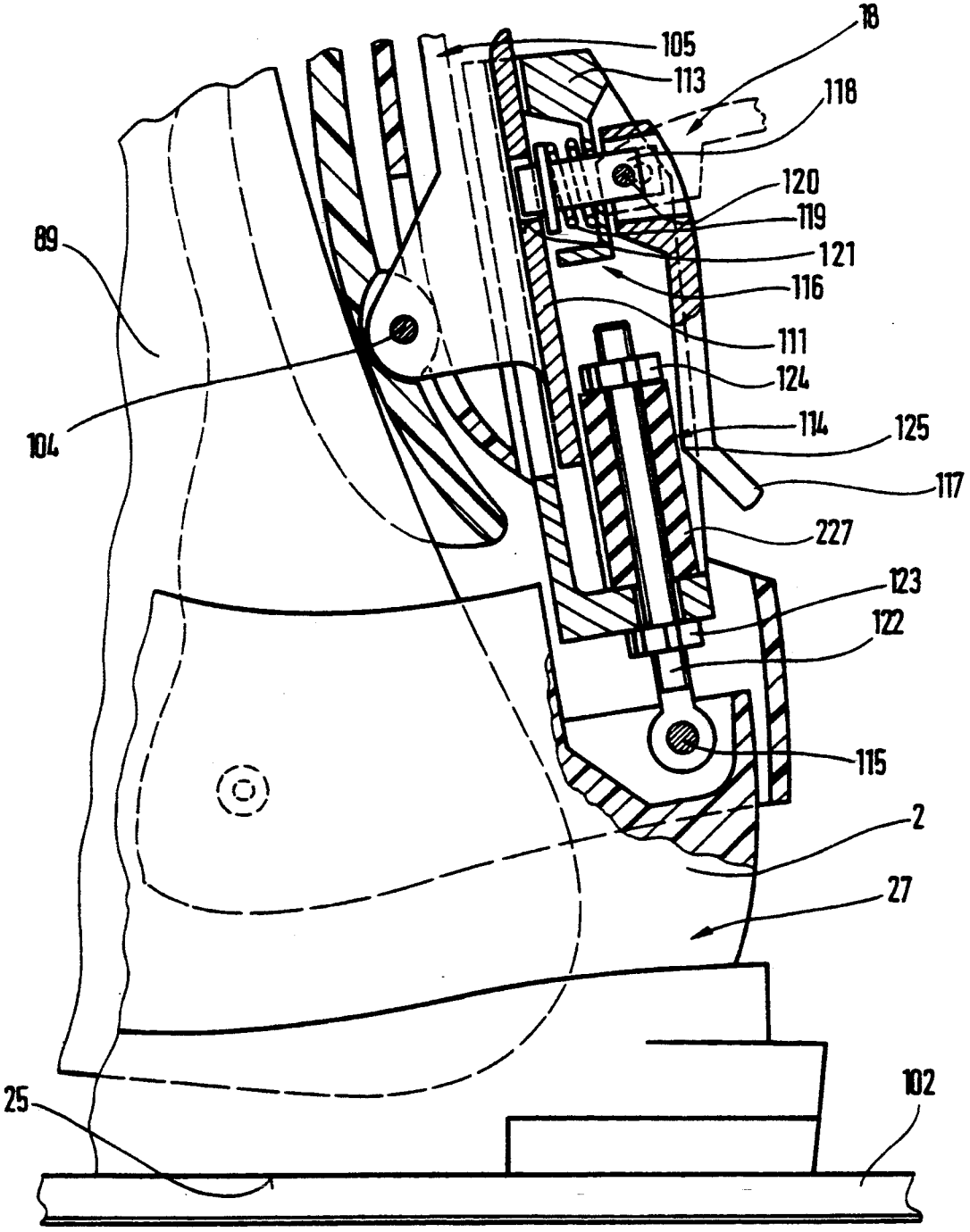
Figure 10F:
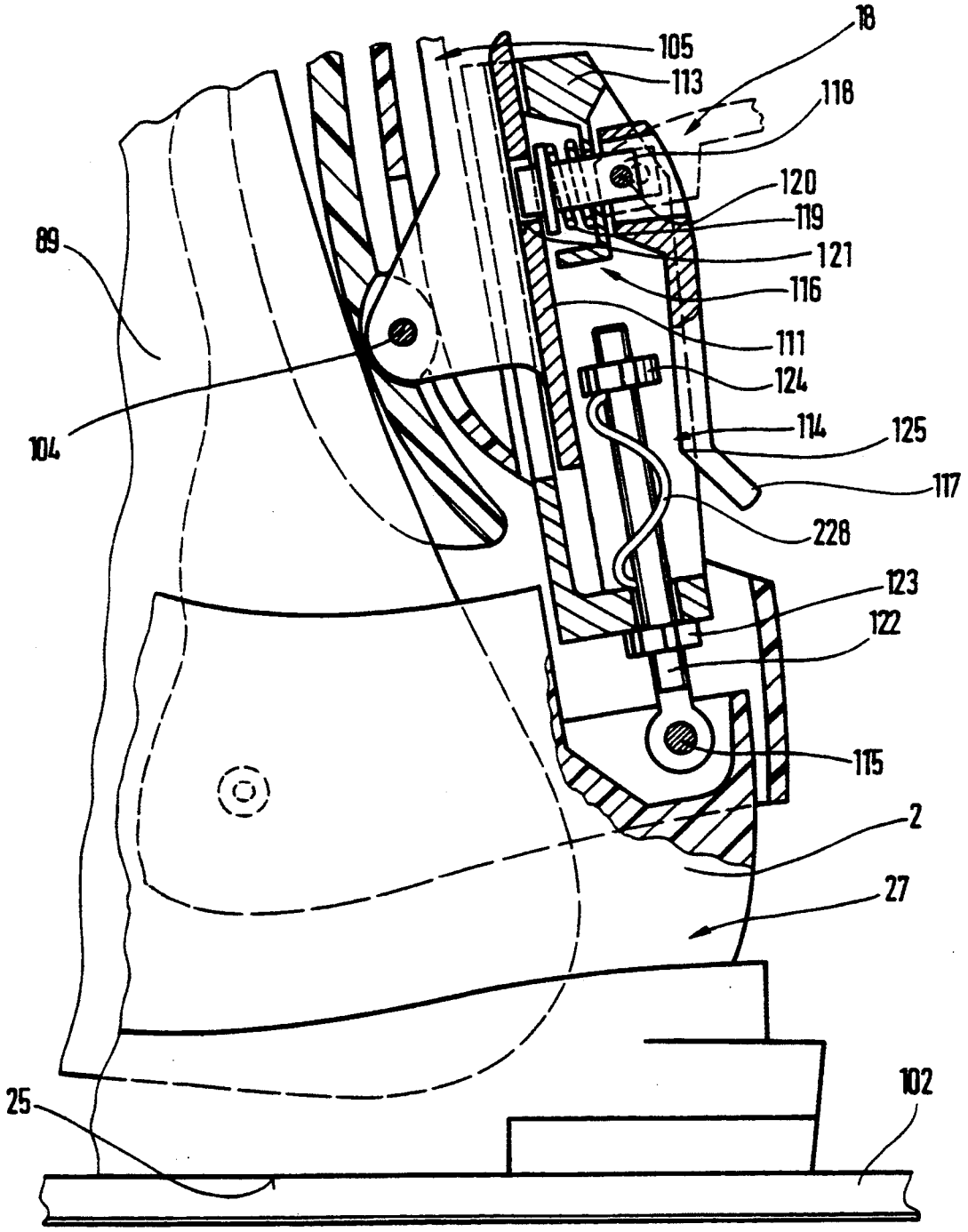
Figure 10G:
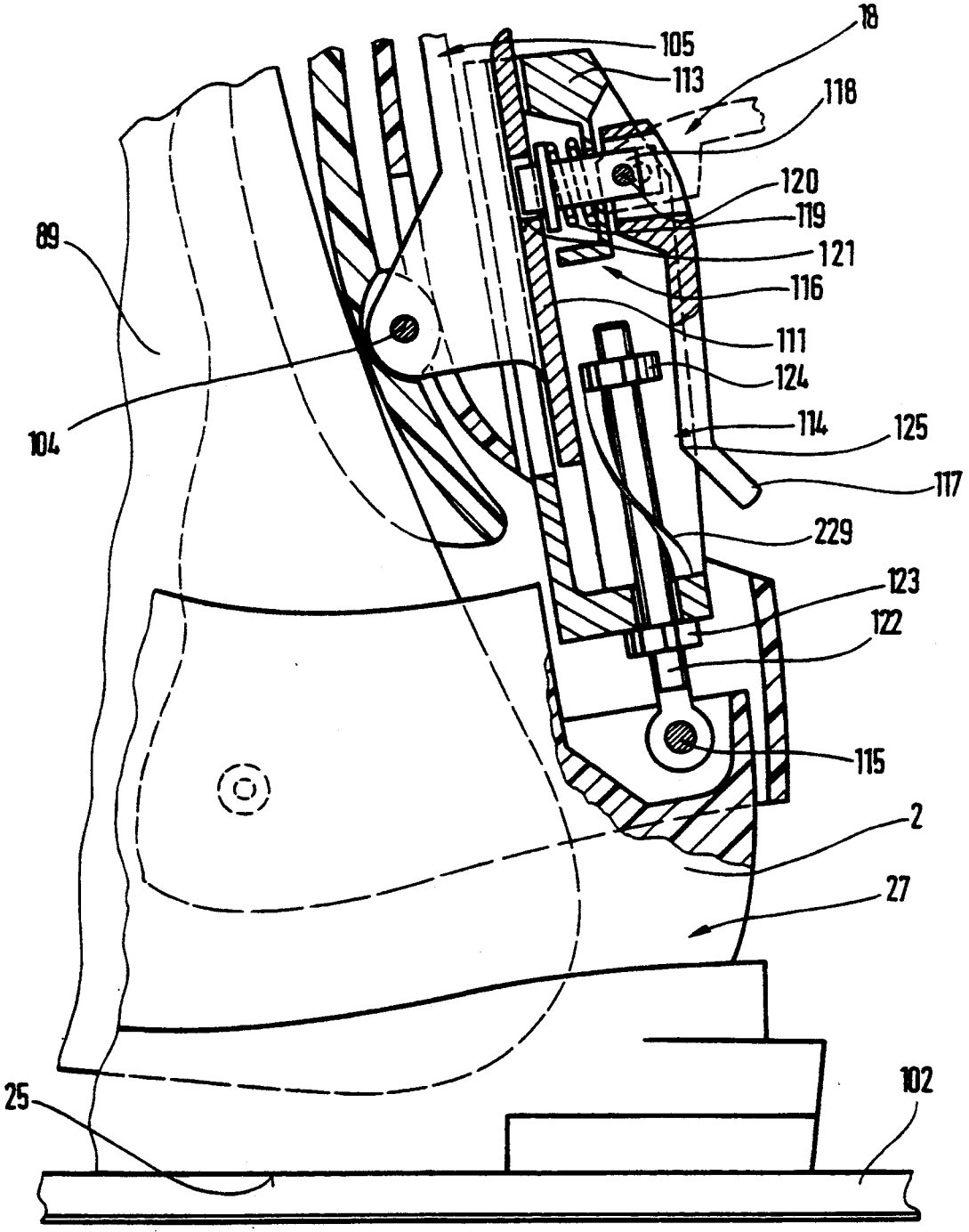

Of course it is possible, within the scope of the invention, to replace the pressure spring 125 with any desired other type of damping device, for example a gas spring [FIG. 10C], elastic materials, such as plastics [FIG. 10D] or rubber [FIG. 10E], with plate spring packages [FIG. 10F] or similar items, or, for example, with torsion rods [FIG. 10G].

In the same way, the fixation device 110 of the setting device 101 can also be formed according to any possibilities existing according to the state of the art. It is possible, among other things, that the housing part 105 has gear tooth segments 127 arranged on it in the region of the guide 106, as shown schematically in FIG. 10B. A gear wheel 128 can be assigned to these gear segments, which can be connected with a stepper motor or any other type of motor 129, as indicated schematically with broken lines. This allows adjustment of the support bracket 103 of the heel adjustment by push buttons or remote control, for example.

The advantage of the setting device 18, particularly in this integrated coupling device 116, is that after unlocking of the coupling device 116, very great relative movement between the lower shell part 2 and the rear flap 6 is possible, which makes it possible to achieve the wide open positions shown in FIG. 9 and described.

The combination of the setting device 18 with the setting device 101 as shown in FIG. 10A merely represents a preferred further development of the present invention. Of course it is also possible to leave out the setting device 101 and to connect the housing part 105 with the rear flap 6 without inserting the guide 106 and fixation device 110.

Figure 11:
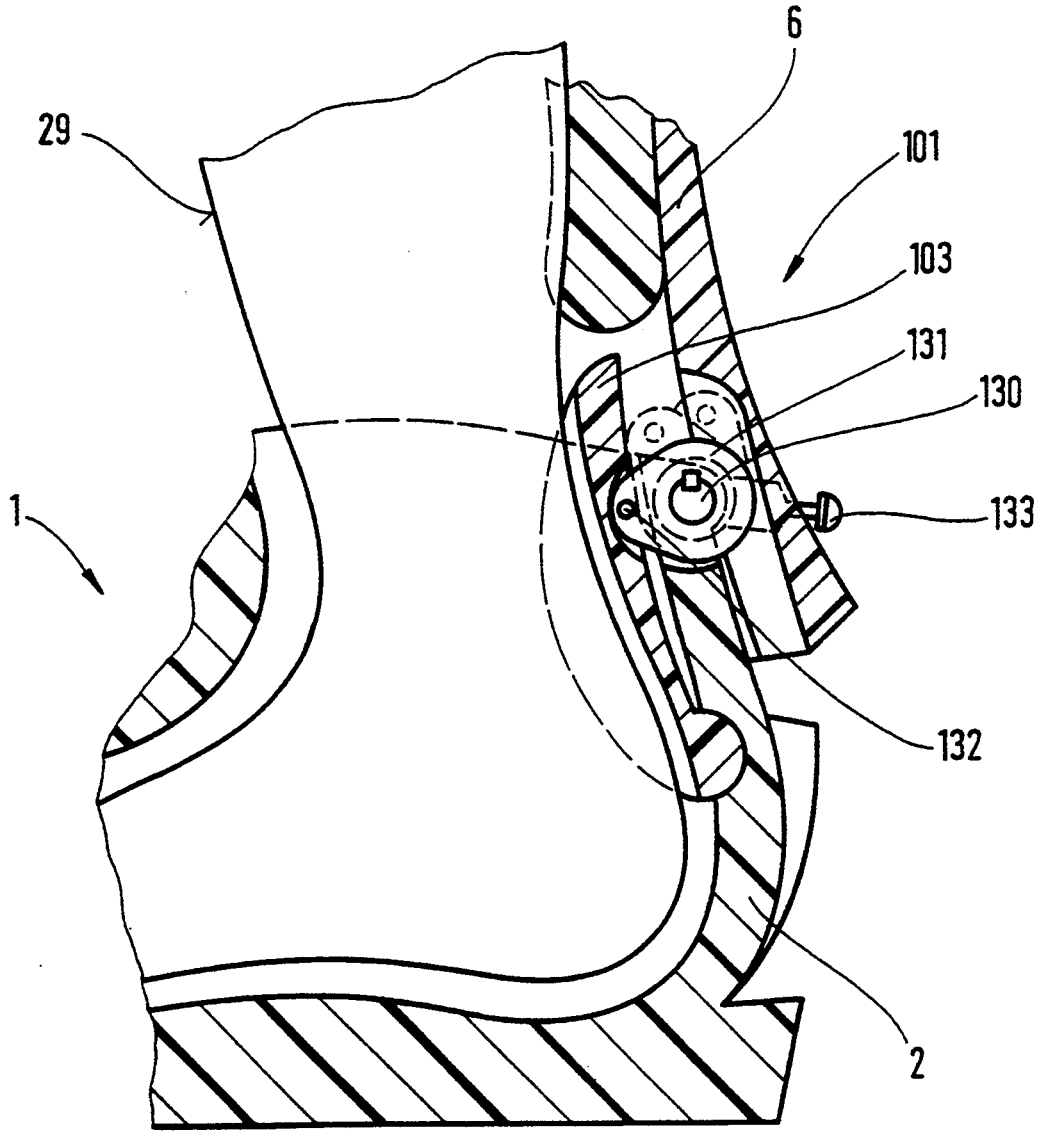
FIG. 11: another embodiment of a setting device for heel adjustment, in a side view, in cross-section.

FIG. 11 shows another embodiment of a setting device 101 for heel adjustment. To adapt the support bracket 103 to the leg 29, a drive shaft 130 is mounted in the lower shell part 2 of the ski boot 1. On this drive shaft 130, an eccentric cam 131 is arranged and fixed to rotate with it. Via an axis 132, the support bracket 103 is jointed to the cam 131. By means of an activation lever 133 which is fixed to rotate with the drive shaft 130, the cam 131 can be pivoted, so that it can be adjusted between the positions shown with solid lines and with broken lines, to adapt it to the progression of the leg 29 in question, in this region. Such a setting device 101 can, of course, also be used together with the setting device 18 for forward position damping.

A further advantage of this setting device 101 is that the drive parts, especially the cams 131, are housed under the rear flap 6 and therefore are protected against damage from the outside, and that the rear flap 6 does not have to be slit to arrange them, so that the risk of moisture penetration, etc., is also less. In the embodiment shown, the support bracket 103 is shown resting directly against the leg 29.

Figure 13:
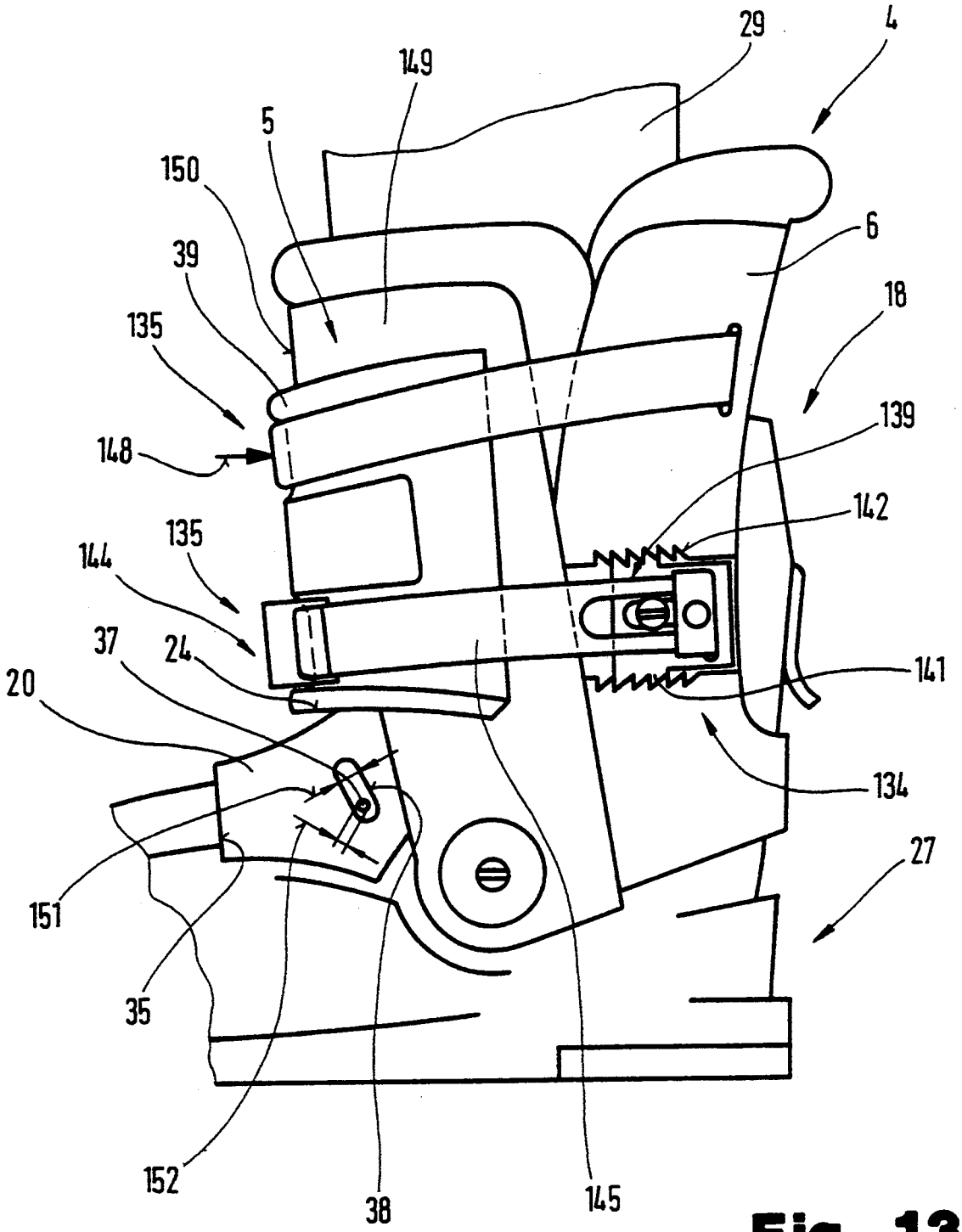
FIG. 13: the setting device for heel adjustment in a side view.

Another embodiment of a setting device 134 and a buckle arrangement 135 is shown in FIG. 12 and 13. The setting device 134 for positioning of a support bracket 103 for heel adjustment consists of a buckle arrangement 135 connected with the support bracket 103, which is connected with a carrier strap 137 by means of a rivet 136. This carrier strap 137 is connected with a holder element 139, for example via screws 138. Depending on the position of this holder element 139 in the longitudinal sole direction 26, the support bracket 103 is distanced more or less from the rear flap 6, and can therefore be adapted to different anatomical conditions of the leg 29 in the region of the Achilles tendon, i.e. in the heel region 27. As shown schematically, several bores 140 can be provided in the holder element 139, in order to create several intermediate positions. This setting can also take place in that the holder element 139 is provided with gear teeth 141, which work together with gear teeth 142 arranged in a depression 143 in the rear flap 6. The holder element 139 can be fixed in place via a tension screw 144, when the gear teeth 141 and 142 mesh. In order to allow turning of the tension screw 144 from the outside, the nut provided on the inside is anchored in the rear flap 6 so that it cannot rotate. By using the gear teeth 141, 142 and with the relative adjustment between the holder element 139 and the rear flap 6 which is made possible by this, delicate adjustment of the support bracket 103 is possible.

This support bracket 103, can, however, also be used to adjust a carrier strap 145, as shown in the bottom part of FIG. 12, if, for example, adjustment of the support bracket 103 takes place via the screw 138 and the bores 140. This makes it possible to center an eccentric buckle 146, which is arranged in the center region of the support plate 39, on a central longitudinal axis of the boot, so that closing of the rear flap 6 and the front flap 5 essentially takes place in centered manner. However, in order to be able to use the holder element 139 for positioning of the support bracket 103, for example, and still be able to align the eccentric buckle 146 on a longitudinal boot axis, i.e. central longitudinal axis of the shaft, it is possible to connect the holder element 139 with a stop element 147, which serves to lock a catch strap 45 connected with the eccentric buckle 146 in place. This embodiment is shown in the upper half of FIG. 12 as a variation. Of course it is possible to provide the eccentric buckle with a catch strap 45 in both end regions, instead of the carrier strap 145, and to arrange such a stop element 147 in the region of both holder elements 139. This makes it possible to achieve completely flexible adjustment of the eccentric buckle 146.

This centered tension effect which is exerted on the support plate 39 in the direction of an arrow 148 is important because this prevents edge mismatch of the support plate 39 relative to the front flap 5, which consists of two front flap parts 149, 150 in FIG. 13. The connection element between the two front flap parts 149 and 150 is formed exclusively of the support plate 39, so that in case of eccentric tension caused by the buckle arrangement 135, the front flap parts 149, 150 can be deformed to different degrees. The same advantage of central tension is particularly advantageous, however, when the support plate 39 is used in combination with the version of the front flap 5 as described in FIG. 2 to 9, since the tab 48 as well as the guide tabs 49 and 50 cannot be compressed and jammed in the guide arrangements 51. However, the function of the support surface 24 and its location relative to the instep cover 20, i.e. the weakening line 35, is defined more precisely with this.

FIG. 13 furthermore shows that for adjustment of the movement of the instep cover 20 to the various pivot positions of the shaft 4, the sliding track 38 can have a greater width 151 than one width or one diameter 152 of the guide element 37 which can be moved along this sliding track 38. This makes it possible for the location of the instep cover 20 to be adapted to the various movement radii, depending on whether the instep cover 20 is pivoting around the weakening line 35 or the holder device 56 of the shell cover 3, as well as to a straight progression of the sliding track 38.

Figure 14:
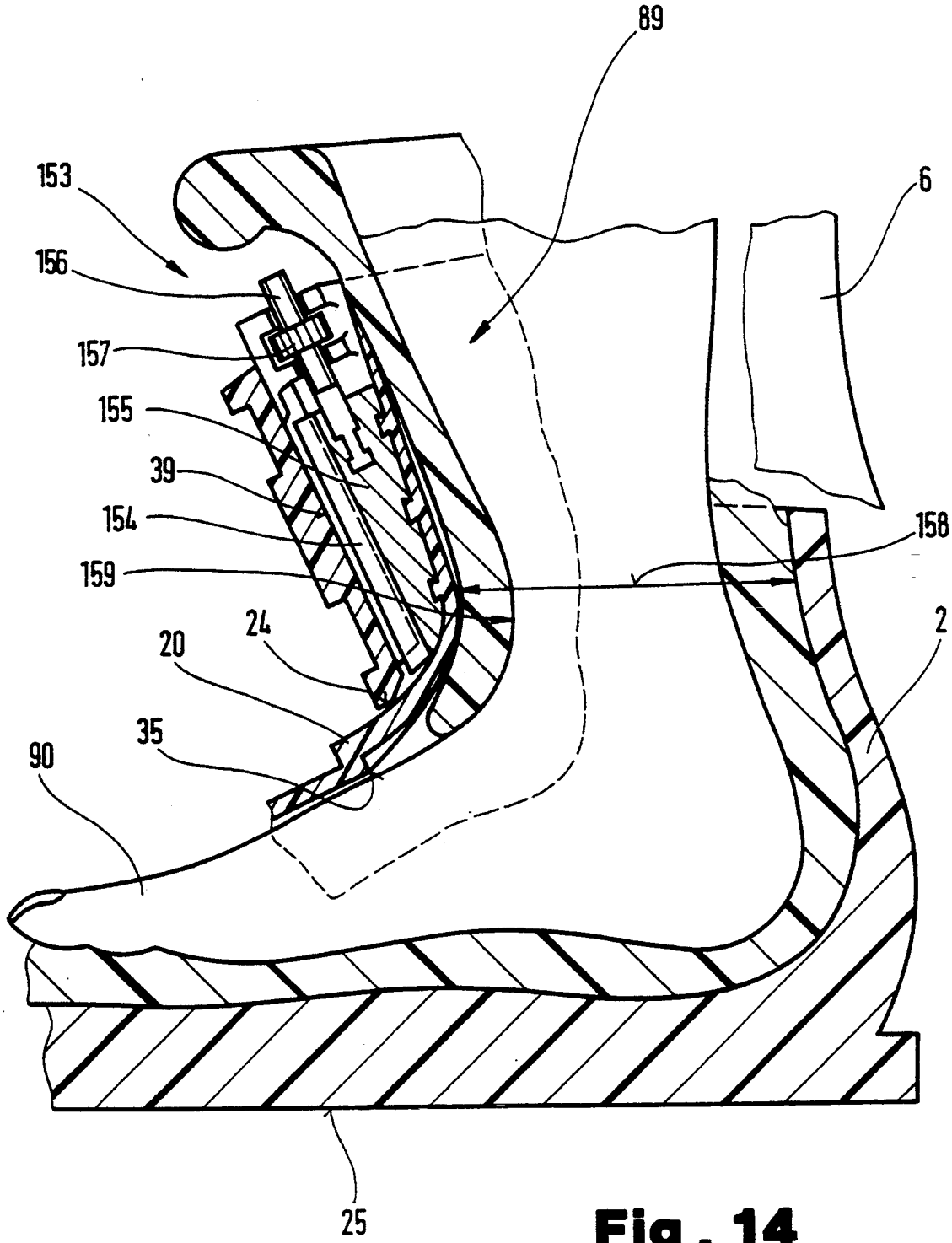
FIG. 14: the front flap of the shaft with the setting device for shin adjustment, in a side view, in cross-section.

FIG. 14 shows an embodiment of a setting device 153, preferred in connection with the use of a support plate 39, with which adjustment to various progressions of the shin can take place. In particular, this setting device 153 allows the use of the instep cover 20 in interaction with the support surface 24 of the support plate 39, and therefore the same movement mechanics as already described on the basis of the above figures, in connection with the weakening line 35 or the axis 21. Between the instep cover 20 and the support plate 39, a wedge cushion 155 is adjustable in a guide slit 154, via a setting device 153 which is formed of a screw 156 and an activation wheel 157, approximately parallel to the support plate 39. The screw 156 is connected to move together with the wedge cushion. If the screw 156 is moved in the direction of the sole 25, by turning the fixed activation wheel 157, the pressure point, i.e. the progression of the instep cover 20 is displaced in the direction of the sole 25, and at the same time, a distance 158 to the lower shell part 2, i.e. to the rear flap 6 arranged above it, is reduced, which also makes it possible to equalize a concave transition region 159 between the lower leg 89 and the foot.

At this point, it should be explicitly pointed out that the anatomical progression of the foot, as well as individual parts of the ski boot, are shown purely schematically, and exaggerated in terms of proportion and size in many embodiment examples shown in this application, in order to illustrate the function and method of effect of the individual setting devices, i.e. the movement progression of the individual boot parts when the foot is moved.

In addition, the individual setting devices 18, 55, 101, 134 and 153 can be exchanged for one another in any way desired, and be used in any combination with one another, in the ski boot 1. Furthermore, the structure of these setting devices 18, 55, 101, 134 and 153 can represent an independent, autonomous invention, even without the structure of the instep cover 20 according to the invention, in interaction with the support surface 24, i.e. the shell cover 3. It should be stated, however, that the combination of the setting devices with the instep cover 20 as described above results in a number of additional advantages, when using a weakening line 35 and/or an axis 21, which make their use in combination with the inventive characteristics of the instep cover appear to be particularly preferred.

Figure 15:
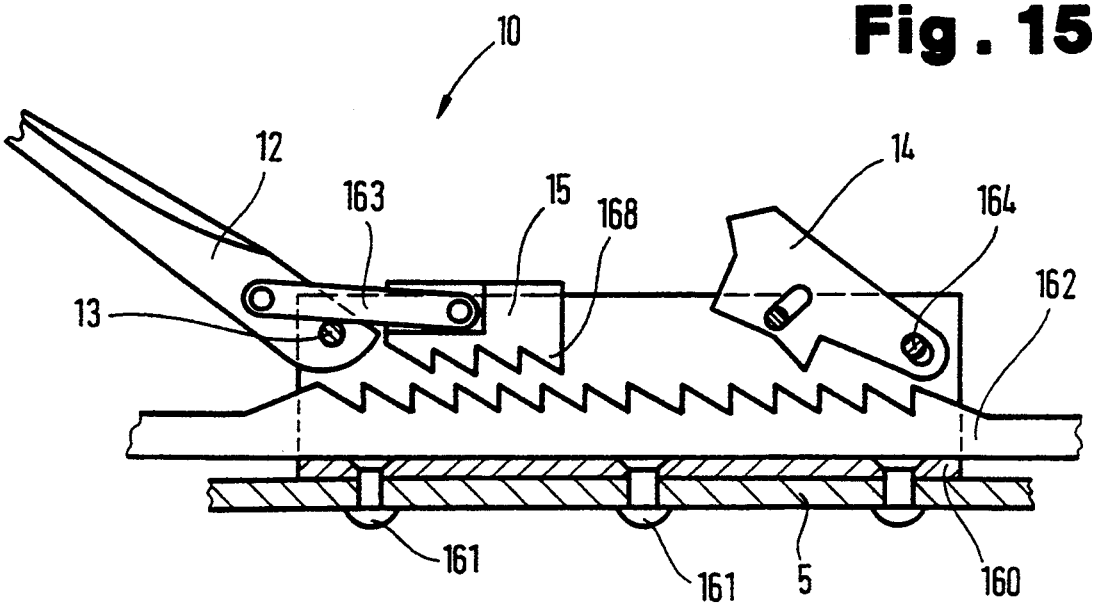
FIG. 15: an embodiment of a buckle arrangement in a side view, in cross-section.
Figure 16:
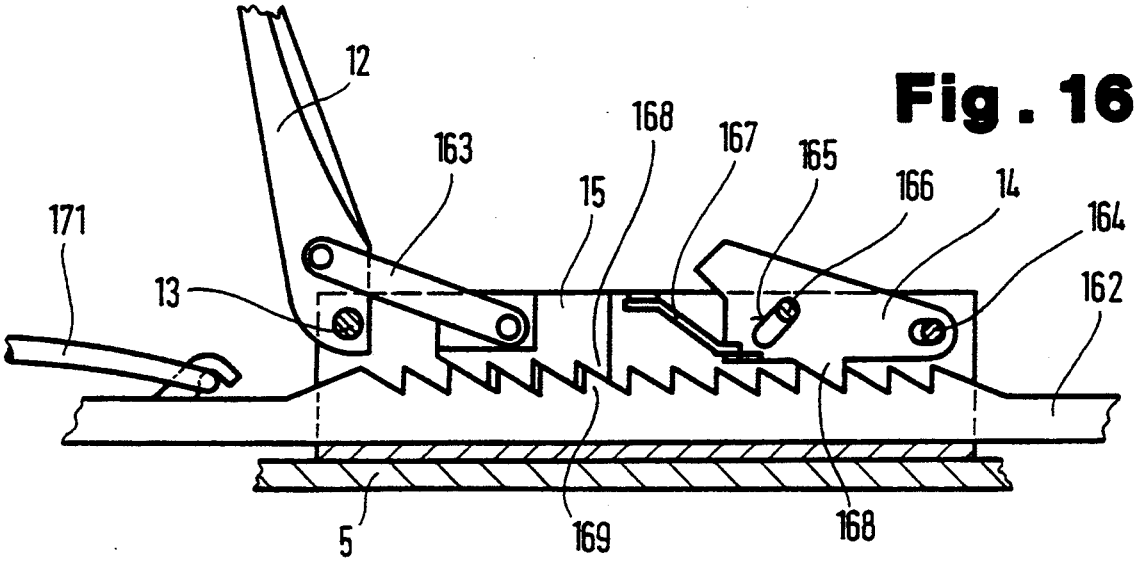
FIG. 16: another position of the buckle arrangement according to FIG. 15.
Figure 17:
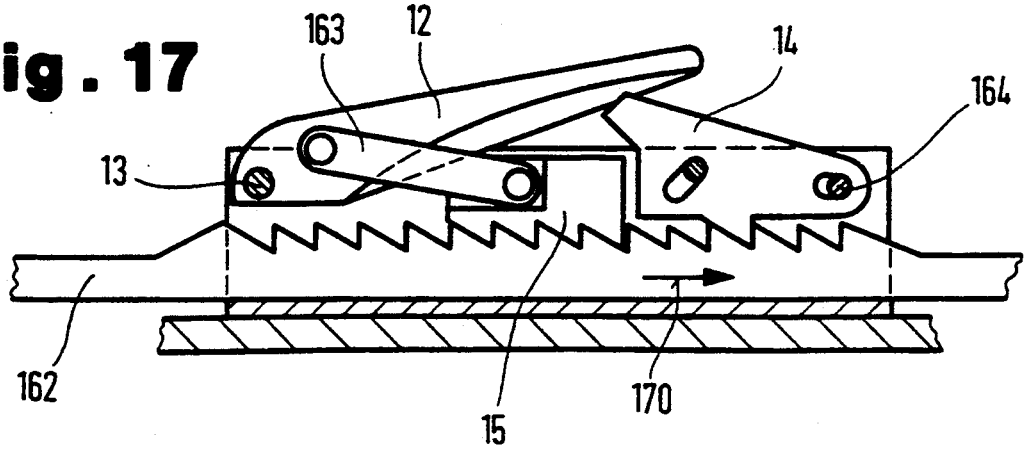
FIG. 17: another position of the buckle arrangement according to FIG. 15, 16.

In FIG. 15 to 17, a possible embodiment of the buckle arrangement 10 shown in FIG. 1 is shown on a larger scale and schematically. A carrier frame 160 of the buckle arrangement 10 is attached to the front flap 5 with rivets 161, as indicated schematically. However, it is also possible to arrange this carrier frame on the support plate 39. In the carrier frame, a catch strap 162 is guided, which runs between a base plate connected with the front flap 5 and the ratchet part 15. The latter is jointed to the activation lever 12 via a push rod 163, with the lever in turn being mounted to rotate on the carrier frame 160 via an axis 13. Furthermore, the catch 14 can be pivoted about an axis 164 on the carrier frame 160. The catch is furthermore adjustable along a bolt 166, with a slit 165. Via a pressure spring 167, the catch 14 is held in the position shown with solid lines in FIG. 16 and 17. For unlocking, it can be pivoted up, opposite the effect of the pressure spring 167, as shown in FIG. 15, with the ratchet part 15 being also lifted off the catch strap 162 when the activation lever 12 is pivoted into the position shown in FIG. 15, and therefore gear teeth 168 and 169 of the ratchet part 15 and the catch strap 162 being released from each other. Therefore the catch strap 15 can be moved back and forth as desired in the position shown in FIG. 15. After the catch 14 is released and the activation lever 12 is pivoted forward, as shown in FIG. 16, the gear teeth 168 and 169 of the catch strap 162 and the ratchet part 15 as well as the catch 14 mesh again. With several consecutive movements of the activation lever 12 from the position shown in FIG. 16 to the position shown in FIG. 17, the catch strap 162 can be moved in the direction of the arrow 170, and when the activation lever 12 is pivoted back from the position shown in FIG. 17 to that shown in FIG. 16, the catch strap 162 is held in position by the catch 14.

This makes it possible to provide a large path of adjustment for the catch strap 162, with simple means, but of course this catch strap 162 can be formed, for example, of any other desired arrangement, such as pinions or similar items. It is also possible to attach pulleys 171 on the catch strap, in different positions, as schematically indicated in FIG. 16, which connect the front flap 5 and the rear flap 6, for example, as the pulley 16 in FIG. 1 does. However, any desired transmission element can be used between this ratchet device and the parts which move relative to one another, such as the front flap 5 and the rear flap 6. It is also possible to provide two such buckle arrangements 10, 135, parallel and next to one another in the arrangement shown in FIG. 1, which makes it possible to use the one buckle arrangement for tightening the buckle arrangement in the region of the front flap 5 closer to the upper frontal edge 46 in FIG. 2, and the second buckle arrangement for tightening the buckle arrangement 10 located below it in FIG. 2. The advantage of the buckle arrangement 10 as shown as a possible embodiment in FIG. 1 and FIG. 15 to 17 is that the force can be applied from top to bottom, in other words in a very advantageous direction, and that therefore great forces can be applied, without distortion of the body, as this is sometimes necessary, for example, for tension buckles in the region of the rear flap 6, or even in the region of the side walls.

Of course the buckle arrangement 10 as shown in FIG. 1 and 15 to 17 can also be the object of an independent invention, since the advantages achieved with it with regard to central tension when closing the shaft 4 in connection with the activation aimed in the direction of the sole offer significant advantages as compared to currently known buckle arrangements, which are arranged perpendicular to the longitudinal shaft direction or in the region of the rear flap 6. Of course it is also possible to use such buckle arrangements with activation in the longitudinal sole direction 26 in the region of the shell cover 3 or the front foot cover 19.

Furthermore, it is also possible to use any desired type of setting device for the forward position in connection with the characteristics according to the invention, which are brought about by the interaction of the support surface 24 with the instep cover 20 and the weakening line 35 or the axis 21, for example also in the region of the front flap 5. In the same way, the canting setting, i.e. the setting of the lateral incline of the shaft relative to the shell, can also be selected as desired. As variations for such setting devices, reference is made to AT-PS 378 897, 370 954, 370 956, EP-OS 171 384, EP patent applications 85890152 and 85890153 and DE-OS 28 07 348.

Figure 18:
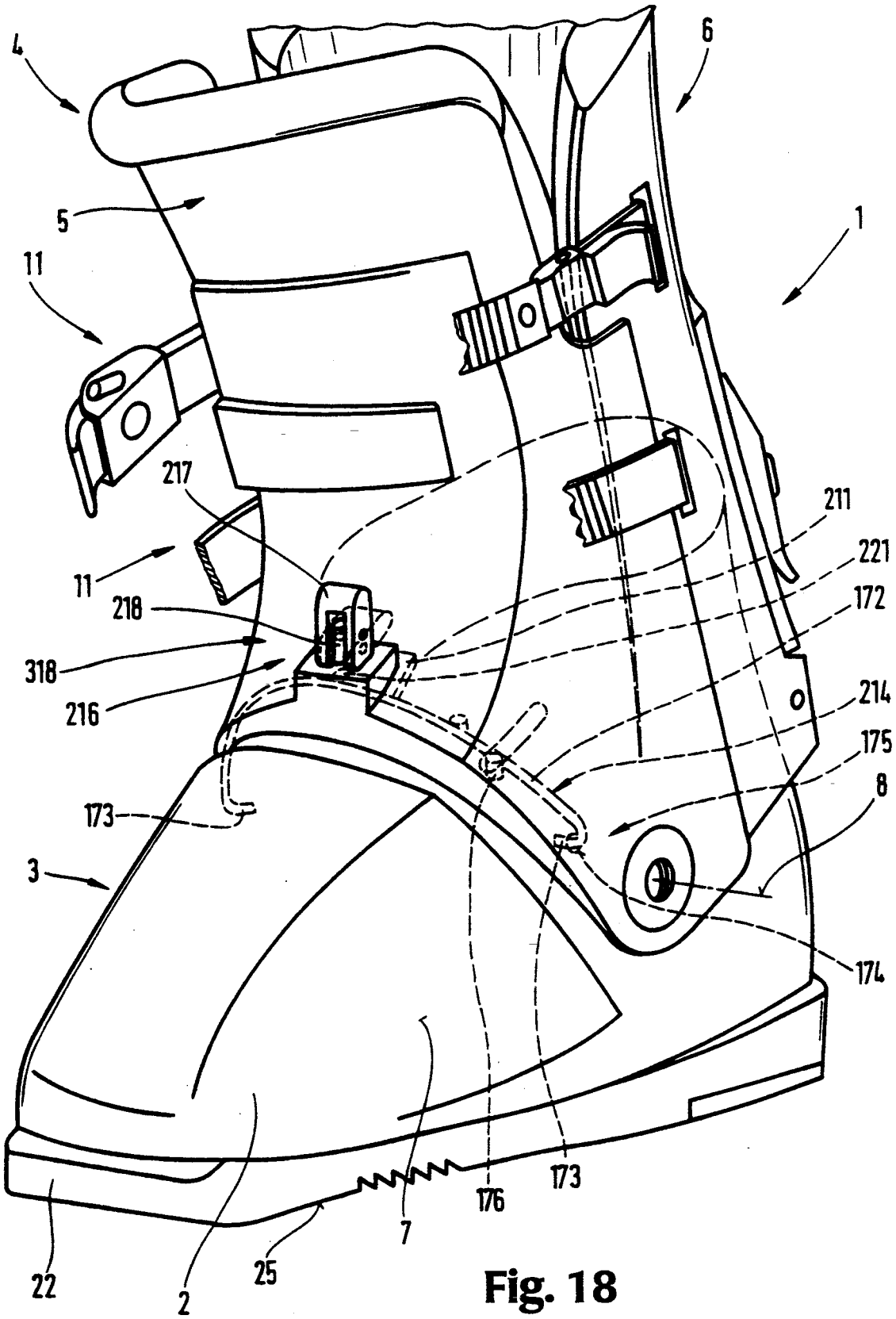
FIG. 18: a ski boot with a setting device according to the invention for setting of the forward position of the shaft in the region of the front flap, as an illustration.
Figure 19:
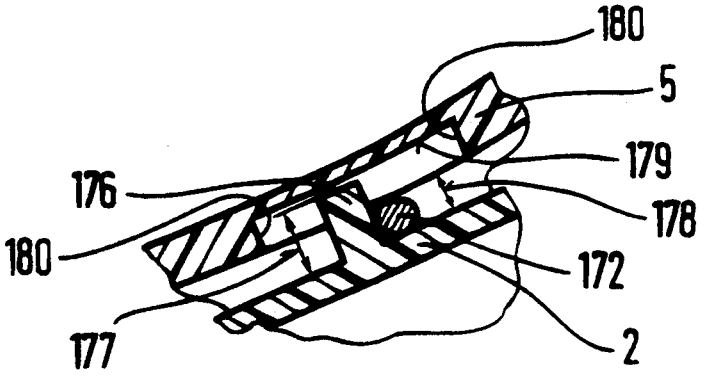
FIG. 19: a part of the ski boot in the region of a stop device, in a side view, in cross-section.

FIG. 18 and 19 show the ski boot 1 which consists of the lower shell part 2 with the sole 25, the side walls 7 and the shell cover 3, which is formed in one piece with the side walls 7, as well as the shaft 4 which can be pivoted relative to the lower shell part 2 around a pivot axis 8, with a front flap 5 and a rear flap 6.

The front flap 5 and the rear flap 6 can be brought into a fixed position relative to one another via buckle arrangements 11. In order to limit the forward movement, i.e. the relative movement between the shaft 4 and the lower shell part 2, or to allow unhindered movement in a walking position and damped movement, via a damping device 214, in a skiing position, a setting device 318 for the forward position is arranged between the front flap 5 and the lower shell part 2. This consists of a coupling device 216, of which an eccentric lever 217 of the locking tab 218 and a spring element 172 which forms the damping device 214 are shown.

The spring element 172, as can be seen from the drawing, is arranged in that part of the lower shell part which is covered by the front flap 5. The spring element consists of an approximately U-shaped stirrup, which has shanks 173 at each of its two ends, lying opposite one another in the region of the side walls 7, which mesh in bores 174 in the lower shell part 2, which form part of the holder device 175. This holder device 175 furthermore also comprises counter-bearings 176, for example tabs molded onto the lower shell part 2 or attached to it, which are arranged between the spring element 172 or the boot tip 22. If the eccentric lever is placed in the walking position, the locking tab 218 is moved far enough away from the lower shell part 2 so that the locking tab 218 is located above the spring element 172. In this position, the front flap 5, i.e. the shaft 4, can be moved about the pivot axis 8 without any restriction. In order to prevent the front flap 5 from moving forward or back into the overlap region with the lower shell part 2 when this is done, the counter-bearing 176, i.e. the tab 218 has a height 177 which is greater than the distance 178 between the facing surfaces of the lower shell part 2 and the front flap 5, as is more clearly evident from FIG. 19.

The tab of the counter-bearing 176 meshes into a groove 179 of the front flap 5, which is arranged on the side facing the lower shell part 2. The movement or adjustment range of the front flap 5 relative to the lower shell part 2 is limited by a counter-bearing surface 180 of the groove 179.

If, in contrast, the eccentric lever 217 is pivoted into its position indicated with a broken line, in other words the skiing position, the locking tab 218 approaches the lower shell part 2 in such a way that it meshes with the bore 221 of the guide plate 211 which is connected to move with the spring element 172, when the shaft 4 is moved. For this, it is prestressed against the guide plate 211, with this tension being applied by means of a spring element.

If the locking tab 218 has snapped into the bore 221, the front flap 5 is connected to move with the lower shell part 2 via the spring element 172, and the front flap 5 is therefore damped relative to the lower shell part 2 in its movements. If a counter-bearing surface 180 is arranged on the side of the spring element 172 which faces the rear flap 6, the movements can also be correspondingly damped from a defined middle position, in the direction of the rear flap 6. Depending on the distance between the locking tab 218 and the counter-bearing surface 180, the damping effect can be greater or less.

Figure 20:
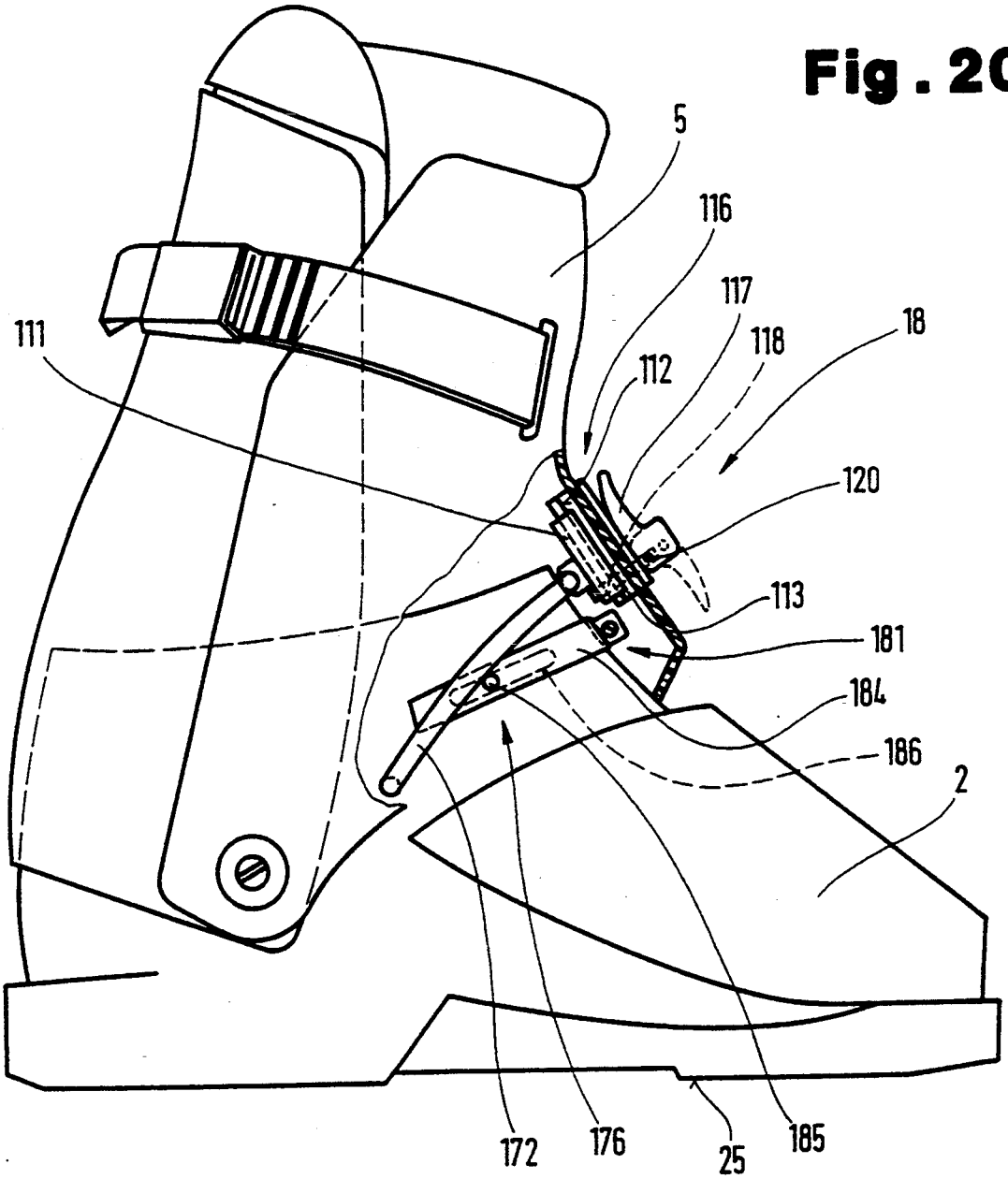
FIG. 20: a ski boot with a different form of a setting device for setting of the forward position of the shaft, in a side view, in partial cross-section and on an enlarged scale.
Figure 21:
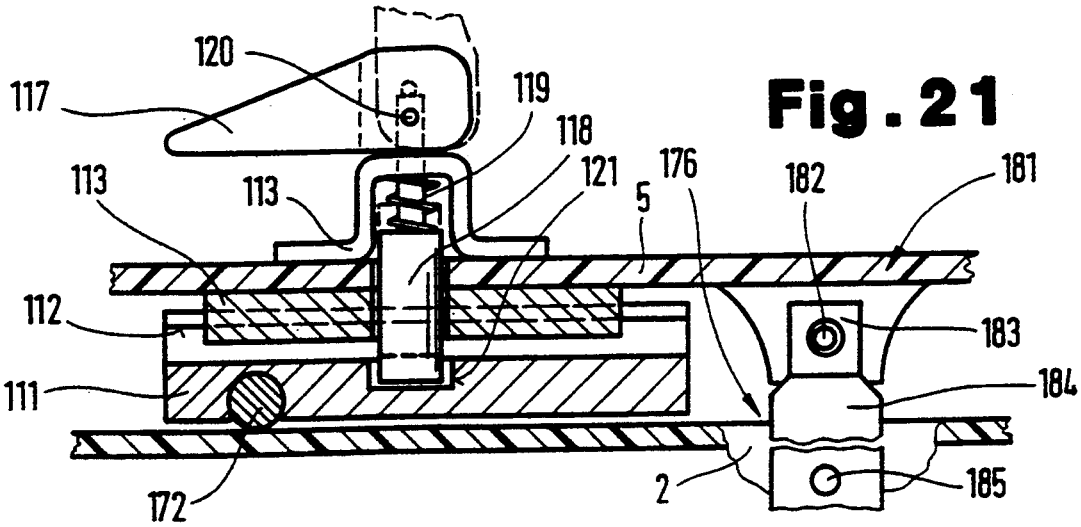
FIG. 21: the coupling device between the front flap and the lower part of the shell which can be opened, according to FIG. 20, in a side view, in cross-section and in a schematically simplified representation.

FIG. 20 and 21 show another embodiment of a setting device 18 for the forward position or forward position damping according to the invention, in which the damping behavior of a spring element 172 can be changed by an adjustment device 181.

As a spring element 172, the same one as already shown in FIG. 18 and described in detail is used in this embodiment. Therefore, the same reference numbers are used for the same parts. The spring element 172 is arranged in that region covered by the front flap 5. It consists of an approximately U-shaped stirrup, which has shanks 173 at each of its two ends, lying opposite one another in the region of the side walls 7, which are mounted in the lower shell part 2. In order to prevent the front flap 5 from pivoting too far backward in the direction of the rear flap 6, a slit guide shown in the front flap 5 in FIG. 19 can be provided, where the tab meshing into the groove 179 can be independent of the counter-bearing 176. Of course it is also possible, in this connection, to provide a corresponding groove in the lower shell part 2, and to mount a tab which meshes with this groove in the front flap 5. If this tab is arranged to be adjustable in the front flap 5, in a longitudinal slit, it is possible to prevent the maximum end positions of the front flap. If two tabs that are adjustable independent of one another are provided, the front and back end position of the front flap can be set independent of one another. This can be achieved, for example, in that the housing 113 is adjustable relative to the front flap. This adjustment device comprises a threaded spindle which runs parallel to the sole 25, with counter-threads, with a migrating nut 183 being arranged on each of the thread segments 182, which is connected to move with an adjustment strip 184. On the adjustment strip 184, a tab 185 which forms the counter-bearing 176 is provided, against which the spring element 172 rests. The adjustment strip 184 is guided in a depression, i.e. in a groove 186 in the lower shell part 2. This causes the tab 185 to form a fixed counter-bearing against deformation of the spring element 172 under the effect of the locking tab 118.

FIG. 21 makes the structure of the coupling device 116 more clearly evident. This comprises an eccentric lever 117 arranged on the surface which faces away from the lower shell part 2, which is connected to move with the locking tab 118, via a pivot axis 120. The pivot axis 120 is mounted away from the center of the eccentric lever 117, so that when the eccentric lever 117 is in the position shown with solid lines, the locking tab reaches through the front flap 5 as well as through the two-part housing 113 of the coupling device 116 arranged on the side facing the lower shell part, into a guide plate 111, which is guided so that it can be adjusted in guide slits 112 on the second part of the housing arranged on the side of the front flap 5 which faces the lower shell part 2.

The guide plate 111 is provided with a bore 121, into which the locking tab 118 meshes and thereby produces a movement connection between the front flap 5 and the guide plate 111 with the spring element 172. The locking tab 118 is supported in the housing 113 via a pressure spring 119, which presses the locking tab 118 in the direction of the lower shell part 2, relative to the housing 113. If the eccentric lever 117 is pivoted into the position shown with solid lines, and if the locking tab 118 is not in a position which covers a bore 121, automatic locking of the locking tab 118 in the bore 121 can be achieved by pivoting the front flap 5, i.e. the shaft 4, and with the resulting relative shift between the front flap 5 and the guide plate 111.

By moving or pivoting the eccentric lever 117 into the position shown with broken lines in FIG. 20, the locking tab 118 is raised against the action of the pressure spring 119 and pulled out of the bore 121. This achieves free relative movement between the front flap 5 and the lower shell part 2.

FIG. 22 and 23 show another embodiment of a setting device 18 between a front flap 5 and a lower shell part 2. As the spring element, an approximately C-shaped stirrup is provided, the shanks 173 of which mesh with bores 174 of the lower shell part 2. The tab 185 which forms the counter-bearing 176 is arranged on adjustment strips 185, which run between the lower shell part 2 and the front flap 5, and connected with a migrating nut 183 in each case, which are mounted on two threaded segments 182 and 187 with counter-threads, e.g. a right-handed thread and a left-handed thread. The two thread segments 182 and 187 are arranged on the threaded sleeve 188, which is provided with recesses 189 for coupling with the eccentric lever 117, and pass through the lower shaft part 2 between the eccentric lever 117 and the threaded segment 187, and the opposite end of which is supported in a bearing location 190 which is also arranged in the lower shaft part 2.

In the threaded sleeve 188, longitudinal slits 191 are arranged, through which a guide tab 193 arranged in a push rod 192 projects, which tab meshes with a groove 194 of the locking tab 118. The guide tab 193 is prestressed in the direction of the threaded segment 187 by means of a pressure spring 119. Depending on the position of the eccentric lever 117, the push rod 192 can now have a different position relative to the threaded sleeve 188, and accordingly, the locking tab 118 meshes with the bores 121 of a coupling part 195, which is connected to move with the spring element 172. If the eccentric lever 117 is pivoted down against the lower shell part 2, as shown in FIG. 22, the locking tab 118 moves completely out of the bore 121. This uncouples the front flap 5 from the spring element 172, and it can then be pivoted without restriction, relative to the lower shell part 2.

FIG. 23, in contrast, already shows this uncoupled position with solid lines, in which the locking tab 118 has already come out of the bores 121 of the coupling part 195. This now achieves free mobility of the shaft 4, i.e. the front flap 5, relative to the lower shell part 2.

Of course it is also possible to produce the coupling device 116 with the push rod 192 by leaving out the threaded sleeve 188, and to provide no adjustment device 181, or a different known one, for the change in the damping characteristics. Furthermore, it is also possible to provide any desired other type of adjustment device for the damping properties.

It is furthermore also advantageously possible to use such spring elements 172 as described in our parallel patent applications A 1960/87 and A 1961/87, with the shanks which deform there having to be brought into a movement connection either with the housing 113 or the guide plate 111, and thereby forming the counterbearings, via which front flap 5 rests on the lower shell part 2 when the coupling device 116 is engaged. The object of our two older patent applications A 1960/87 and A 1961/87 is therefore made part of the disclosure of the present application.

Figure 24:
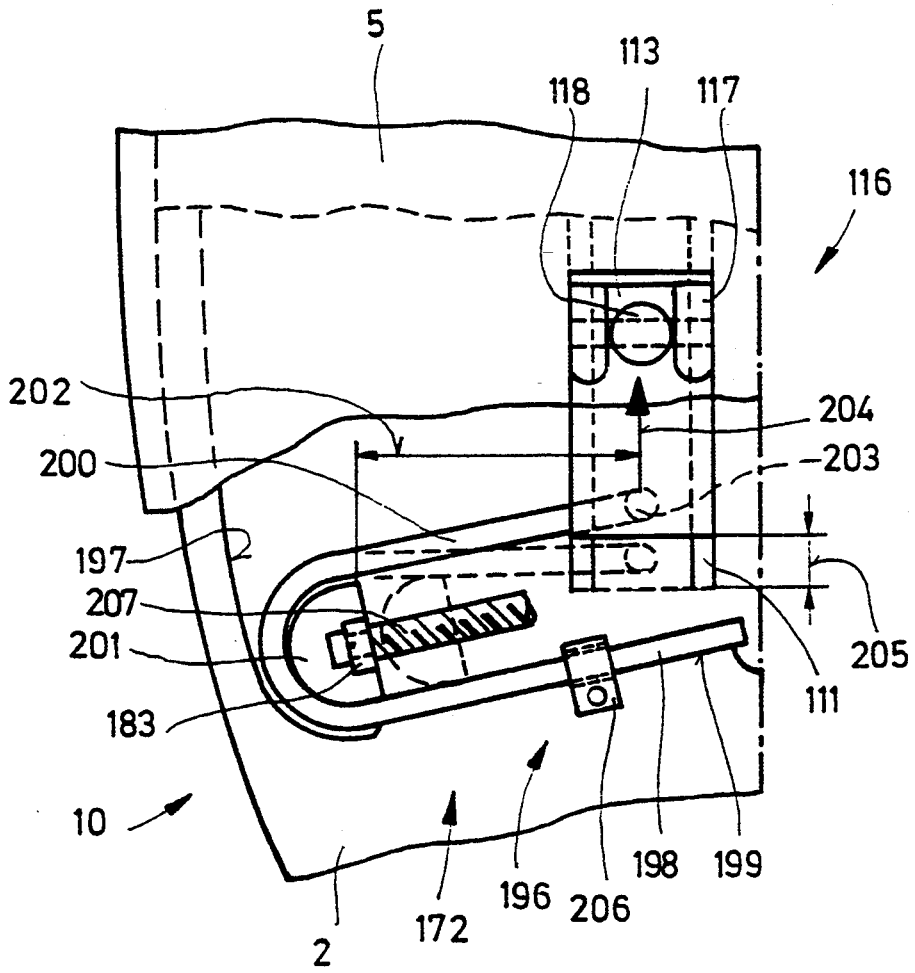
FIG. 24: another embodiment of a setting device according to the invention, with a U-shaped spring element, in a top view, in partial cross-section and in a schematically simplified representation.

FIG. 24 shows a spring element 172, which is formed of a U-shaped elastic spring stirrup 196. This rests in a depression 197 of the shell 2 and rests against a frontal wall 199 of the depression 197, facing the boot tip, with its shank 198, with only the outside half of the ski boot 1 being shown. Between the shank 198 and another shank 200 of the U-shaped spring stirrup 196, a stop 201 is arranged at a distance 202 from a shank 203 of the U-shaped spring element 172, which shank runs in the direction of the front flap 5 and is connected to move with the coupling device 116 shown in FIG. 21, for example. The housing 113 of this device is connected to move with the front flap 5, as is shown in simple schematic form. Furthermore, the eccentric lever 117 and the locking tab 118 are also shown. With regard to the method of operation of the coupling device, reference is made to the explanations relating to FIG. 21. The front flap 5 of the ski boot 1 rests on the shank 200 via the guide plate 111. By changing the distance 202 of the stop 201 from the shank 203, different spring paths result under the effect of a support force 204 of the same value on the shank 200, because of the different bending lengths of the shank 200. These result in different damping characteristics, since in the position shown with solid lines, a greater damping path 205 of the shank 200 which acts as a bending rod is achieved as compared to the damping path for the setting of the stop 201 as shown with broken lines, because of the different spring characteristics. The damping behavior in the position shown with solid lines is therefore softer and the setting shown with broken lines is harder. This means that when an equally strong support force is exerted, the lower leg travels a greater distance until the support force is completely deflected into the lower shell part 2. This results in force conduction between the foot of the user and the ski boot 1, i.e. the ski attached to it, which is slower in the setting shown with solid lines, as is necessary when skiing in deep snow, for example, in order to prevent the ski from "diving" or digging into the deep snow, due to sudden transfer of force between the foot and the ski boot or the ski, which often results in a fall of the ski boot user. On hard trails, in contrast, it is desirable that the forces required for control of the skis are transferred as immediately as possible, in order to prevent slipping, especially on hard trails and steep terrain. By changing the distance 202, the spring characteristics of the spring element 172 can therefore be varied within a wide range, in simple manner. Of course it is also possible that the frontal wall 199 of the depression 197 is provided with a cross-section shape adapted to the cross-section shape of the spring stirrup 196, so that during use of the ski boot 1, the spring element 172 can be prevented from jumping out of the depression 197. This can also be achieved with holders 206 attached at the lower shell part 2, however, as schematically indicated.

To adjust the stop 201, this can be connected to move with a migrating nut 183, which is mounted to be adjustable on a threaded spindle 207. It is possible to arrange the stop 201 on a separate threaded spindle 207. It is also possible, however, to provide only a single threaded spindle 207, which is equipped with counter-threads, so that when it is turned, the stop 201 shown, as well as migrating nut 183 assigned to a further stop 201, arranged on the inside half of the ski boot 1, in a mirror image relative to the axis of symmetry, can be moved counter to one another, in other words closer or farther apart.

Of course it is also possible, with this embodiment, to support the spring elements 172 with stops rigidly attached to the lower shell part 2 in the curved transition region between the shanks 198, 200. In the same way, however, it is also possible to structure the stops 201 as shown, with a curve corresponding to the spring element 172 on the side facing the bent end regions of the spring element 172, which makes it possible to utilize the adjustment path of the stops in optimum manner. The embodiments described above according to FIG. 18 to 24 represent an independent inventive solution idea, independent of the other characteristics in the other embodiments. In the same way, the structure of the spring elements 172 can be changed in many ways and instead of the stirrup-shaped or U-shaped spring elements, C-shaped spring elements or fat springs, torsion springs or similar items can also be used.

I claim:

1. An improved composite shell-type ski boot having an outer shell for enclosing a foot, a shaft pivotally coupled to the outer shell for enclosing a lower part and ankle of a lower leg, the shaft including a rear flap pivotally coupled to the outer shell and a front flap pivotally coupled to the outer shell, wherein the improvement comprises:

an adjustment device for adjusting the shaft to a forward position with respect to the outer shell, said adjustment device including an adjustable damping device connected between said outer shell and said shaft for providing damping between the shaft and the outer shell and for adjusting the damping force therebetween, said adjustment device including:

(i) a guide plate connected to the rear flap of the shaft and movable relative to the outer shell, said guide plate including a bore; and (ii) a coupling device disposed adjacent to said guide plate, said coupling device including:

(a) a locking tab cooperatively shaped and dimensioned slightly smaller than the bore to be inserted into the bore and into contact with said guide plate for releasably locking said guide plate to said outer shell to provide damped relative movement therebetween;

(b) biasing means mounted on said locking tab for continuously biasing said locking tab toward said and (c) a guide slit with said guide plate of the rear flap being freely movable along said guide slit when said coupling device is in an unlocked position.

2. An improved composite shell-type ski according to claim 1, wherein the shaft includes a variable incline pivot axis.

3. An improved composite shell-type ski boot according to claim 2, wherein said coupling device further includes an eccentric lever coupled to said locking tab for pulling said locking tab out of the bore against the biasing force of said biasing means.

4. An improved composite shell-type ski boot according to claim 3, wherein said adjustable damping device comprises a threaded rod with a cooperatively threaded nut and a spring mounted on said rod wherein said nut is rotatable to adjust the damping force of said spring on the shaft.

5. An improved composite shell-type ski boot according to claim 1, wherein said adjustable damping device is selected from a group consisting of a gas spring, an elastic material, a plastic material, a rubber material, a plate spring and a torsion rod.

6. An improved composite shell-type ski boot having an outer shell for enclosing a foot, a shaft pivotally coupled to the outer shell for enclosing a lower part and ankle of a lower leg, the shaft including a rear flap pivotally coupled to the outer shell and a front flap pivotally coupled to the outer shell, wherein the improvement comprises:

an adjustment device for adjusting the shaft to a forward position with respect to the outer shell, said adjustment device including an adjustable damping device connected between said outer shell and said shaft for providing damping between the shaft and the outer shell and for adjusting the damping force therebetween, said adjustment device including:

(i) a guide plate connected to the outer shell and movable relative to the shaft, said guide plate including a bore; and (ii) a coupling device attached to said rear flap and disposed adjacent to said guide plate, said coupling device including (a) a locking tab cooperatively shaped and dimensioned slightly smaller than the bore to be inserted into the bore and into contact with said guide plate for releasably locking said guide plate to the rear flap of the shaft to provide damped relative movement therebetween, (b) biasing means mounted on said locking tab for continuously biasing said locking tab toward said guide plate; and (c) a guide slit with said guide plate being freely movable along said guide slit when said coupling device is in an unlocked position.

7. An improved composite shell-type ski according to claim 6, wherein the shaft includes a variable incline pivot axis.

8. An improved composite shell-type ski boot according to claim 7, wherein said coupling device further includes an eccentric lever coupled to said locking tab for pulling said locking tab out of the bore against the biasing force of said biasing means.

9. An improved composite shell-type ski boot according to claim 8, wherein said adjustable damping device comprises a threaded rod with a cooperatively threaded nut and a spring mounted an said rod wherein said nut is rotatable to adjust the damping force of said spring on the shaft.

10. An improved composite shell-type ski boot according to claim 6, wherein said adjustable damping device is selected from a group consisting of a gas spring, an elastic material, a plastic material, a rubber material, a plate spring and a torsion rod.

* * * * *